US011412873B2

(12) United States Patent
Kelly et al.

(10) Patent No.: US 11,412,873 B2
(45) Date of Patent: Aug. 16, 2022

(54) CONNECTED KNIFE BLOCK

(71) Applicant: Alarm.com Incorporated, Tysons, VA (US)

(72) Inventors: Michael Kelly, Washington, DC (US); Matthew Daniel Correnti, Newtown Square, PA (US); Robert Nathan Picardi, Herndon, VA (US)

(73) Assignee: Alarm.com Incorporated, Tysons, VA (US)

( * ) Notice: Subject to any disclaimer, the term of this patent is extended or adjusted under 35 U.S.C. 154(b) by 0 days.

(21) Appl. No.: 17/167,777

(22) Filed: Feb. 4, 2021

(65) Prior Publication Data

US 2021/0244216 A1 Aug. 12, 2021

Related U.S. Application Data

(60) Provisional application No. 62/971,494, filed on Feb. 7, 2020.

(51) Int. Cl.

| | |
|---|---|
| ***A47G 21/14*** | (2006.01) |
| ***G07C 9/00*** | (2020.01) |
| ***E05B 47/00*** | (2006.01) |
| ***E05B 73/00*** | (2006.01) |

(52) U.S. Cl.
CPC ..... *A47G 21/14* (2013.01); *E05B 47/0001* (2013.01); *E05B 73/00* (2013.01); *G07C 9/00563* (2013.01); *G07C 9/00571* (2013.01); *G07C 9/00896* (2013.01)

(58) Field of Classification Search
CPC ..... A47G 21/14; G07C 9/00
See application file for complete search history.

(56) References Cited

U.S. PATENT DOCUMENTS

| | | | | |
|---|---|---|---|---|
| 11,073,352 | B1 * | 7/2021 | Radcliff | F41A 17/066 |
| 2021/0127876 | A1 * | 5/2021 | Schmidt | H01F 7/0252 |

* cited by examiner

*Primary Examiner* — Daniell L Negron
(74) *Attorney, Agent, or Firm* — Fish & Richardson P.C.

(57) ABSTRACT

Methods, systems, and apparatus, including computer programs encoded on computer-storage media, for an electronic knife holder. In some implementations, the electronic knife holder includes a microprocessor, a base member that has a first exterior surface containing multiple slots, a lock, and sensors corresponding to the multiple slots. Each of the multiple slots defines an interior space of the base member and is configured to receive a knife blade. When the lock is placed in a locked position, the lock locks one or more knives placed in one of the multiple slots. The sensors are configured to detect if a knife is present in one of the multiple slots.

20 Claims, 23 Drawing Sheets

110a

110b

110c

110d

100

100

600a

600a

CONNECTED KNIFE BLOCK

CROSS-REFERENCE TO RELATED APPLICATIONS

This application claims the benefit of U.S. Provisional Application No. 62/971,494, filed Feb. 7, 2020, and titled "CONNECTED KNIFE BLOCK," which is incorporated by reference herein in its entirety.

TECHNICAL FIELD

The present specification relates to knife blocks.

BACKGROUND

Knife blocks are typically used in residential and commercial settings to hold kitchen knives.

SUMMARY

In some implementations, a knife block includes a locking mechanism that is capable of locking knives that are present in the knife block in place to prevent removal. The knife block may also include a number of sensors capable of detecting the presences of knives in the knife block. The knife block may also include a number of other sensors capable of detecting if the knives present in the knife block are dull.

In some implementations, a knife block is capable of communicating with a security system of a property. The security system receives data collected from one or more sensing devices including, for example, the knife block itself, and uses the collected data to automatically determine if a state of the knife block should be changed. If a state of the knife block is determined to be changed, the security system sends instructions to the knife block to effectuate the state change.

In some implementations, a state change of the knife block includes changing the knife block from an unlocked state to a locked state so that one or more knives in the knife block are locked in place, or changing the knife block from a locked state to an unlocked state so that one or more knives in the knife block are removable. A state change of the knife block may also include turning on an onboard camera to initiate the capture and/or streaming of image data, or turning off an onboard camera to end the capture and/or streaming of image data.

In some implementations, an authorized user instructs a state change through an application, such as a mobile application, on a computing device.

In some implementations, the security system provides notifications corresponding to the knife block to a computing device of an authorized user, e.g., through a mobile application. The notifications may indicate a state change of the knife block, a removal of one or more knives, an identity of a user removing or attempting to remove a knife, and/or an indication that one or more knives are dull. The notifications may request input from the authorized user, such as an acknowledgment.

In some implementations, the knife block is capable of collecting and sending sensor data to the security system. This sensor data may include image data that indicates one or more users interacting with the knife block, acceleration data that indicates whether a user attempted to remove a locked knife, and touch or proximity data collected from one or more sensors that indicates the presence of a knife in the knife block and/or the sharpness of a knife in the knife block.

In one general aspect, an electronic knife holder includes: a microprocessor; a base member having a first exterior surface that contains multiple slots, each of the multiple slots defining an interior space of the base member and configured to receive a knife blade; a lock that, when placed in a locked state, locks one or more knives placed in one or more of the multiple slots, the lock preventing the one or more knives from being removed from the base member; and sensors corresponding to the multiple slots, the sensors configured to detect if a knife is present in one or more of the multiple slots, where the sensors are electronically coupled to the microprocessor.

Implementations include one or more of the following features. For example, in some implementations, the lock is located in a housing that is coupled to a second surface of the base member.

In some implementations, the lock is housed in the base member.

In some implementations, the base member includes an interior channel that passes through at least a subset of the multiple slots; and the lock includes: a bolt; and an actuator that is configured to move the bolt through the interior channel to lock or unlock one or more knives placed in the subset of the multiple slots.

In some implementations, the sensors include, for each of the slots, a sensor disposed in the first exterior surface of the base member adjacent to a corresponding slot of the multiple slots.

In some implementations, the sensors include, for each of the slots, one or more sensors coupled to an interior surface of the base member in a corresponding slot of the multiple slots.

In some implementations, the sensors include a proximity sensor configured to detect if a knife is present in one or more of the multiple slots by detecting when a knife having a permanent magnet coupled to the knife or embedded in the knife is brought within a detection range of the proximity sensor.

In some implementations, the proximity sensor is a Hall Effect sensor configured to detect if a knife is present in one or more of the multiple slots by detecting when a knife having a permanent magnet coupled to the knife or embedded in the knife is brought within a detection range of the Hall Effect sensor.

In some implementations, the sensors include a contact sensor configured to detect if a knife is present in one or more of the multiple slots by coming into contact with one or more surfaces of a knife inserted into one of the multiple slots.

In some implementations, the electronic knife holder includes a transceiver electronically coupled to the microprocessor, where the microprocessor is configured to: wirelessly send data using the transceiver to a remote computing system, the data including at least one of the following: data indicating that a knife has been removed from one of the multiple slots; data indicating that a knife has been placed in one of the slots; data indicating that the lock is in a locked state; data indicating that the lock is in an unlocked state; or sensor data, or wirelessly receive data using the transceiver from the remote computing system, the data including at least one of the following: instructions to lock the lock; instructions to unlock the lock; a request for a state of the lock; a request for data indicating a number of knives removed from the electronic knife holder; a request for data indicating the slots of the multiple slots that have knives placed in them; or a request for sensor data.

In some implementations, the sensors include a camera disposed in the exterior surface of the base member, where the camera is configured to capture image data of an area in which the electronic knife holder is located.

In some implementations, the microprocessor is configured to: process the image data captured using the camera; perform facial recognition using the processed image data; and perform one or more of the following: modify a state of the lock to unlock the lock if results of facial recognition indicate a user is recognized and if the recognized user is determined to be permitted to retrieve a knife; modify a state of the lock to lock the lock if results of facial recognition indicate a user is not recognized; and modify a state of the lock to lock the lock if results of facial recognition indicate a user is recognized and if the recognized user is determined to not be permitted to retrieve a knife.

In some implementations, the microprocessor is configured to: transmit image data captured using the camera to a remote computing device; receive, from the remote computing device, data indicating that (i) a user is recognized from the image data and (ii) the user is permitted to retrieve a knife from the electronic knife holder; and modify a state of the lock to unlock the lock to allow the user to retrieve a knife from a slot of the multiple slots.

In some implementations, the microprocessor is configured to: transmit image data captured using the camera to a remote computing device; receive, from the remote computing device, data indicating that (i) a user is recognized from the image data and (ii) the user is not permitted to retrieve a knife from the electronic knife holder; and modify a state of the lock to lock the lock to prevent the user from retrieving a knife from a slot of the multiple slots.

In some implementations, the microprocessor is configured to: transmit image data captured using the camera to a remote computing device; receive, from the remote computing device, data indicating that a user is not recognized from the image data; and modify a state of the lock to lock the lock to prevent the user from retrieving a knife from a slot of the multiple slots.

In some implementations, the microprocessor or processor is configured to turn on the camera and instruct the camera to capture the image data in response to receiving sensor data from at least one of the sensors indicating that a knife has been removed or partially removed from a slot of the multiple slots.

In some implementations, the microprocessor or processor is configured to turn on the camera and instruct the camera to capture the image data in response to receiving sensor data from at least one of the sensors indicating that movement has been detected in a vicinity of the electronic knife holder.

In some implementations, the microprocessor is configured to receive instructions to lock the lock based on one or more of the following: time of day; users in a property where the electronic knife holder is located; users in a vicinity of the electronic knife holder; a schedule; a mode of a security system in a property where the electronic knife holder is located; or a detected security event.

In some implementations, the microprocessor is configured to: receive first sensor data; determine that a knife is present in one of the multiple slots of the electronic knife holder based on the first sensor data; receive second sensor data; determine that the knife is dull based on the second sensor data; actuate a lock that locks the knife into the electronic knife holder; and send a notification indicating at least one of that the knife is dull or that the knife has been locked.

In some implementations, the microprocessor is configured to: receive sensor data; in response to the sensor data, turn on a camera of the electronic knife holder; capture image data using the camera; based on the image data, determine that a person in view of the camera is either unknown or is unauthorized to remove a knife; actuate a lock that locks the knife into the knife holder; and send a notification indicating at least on of that an unknown person attempted to remove the knife, that an unauthorized person attempted to remove the knife, or that the knife has been locked.

Other embodiments of these and other aspects disclosed herein include corresponding methods for using electronic knife holder, systems that include the electronic knife holder, and computer programs encoded on computer storage devices, configured to perform the actions of the methods for using the electronic knife holder. A system of one or more computers can be so configured by virtue of software, firmware, hardware, or a combination of them installed on the system that, in operation, cause the system to perform the actions. One or more computer programs can be so configured by virtue having instructions that, when executed by a data processing apparatus such as the electronic knife h older, cause the apparatus to perform the actions.

The details of one or more embodiments of the invention are set forth in the accompanying drawings and the description below. Other features and advantages of the invention will become apparent from the description, the drawings, and the claims.

BRIEF DESCRIPTION OF THE DRAWINGS

Like reference numbers and designations in the various drawings indicate like elements.

DETAILED DESCRIPTION

A security system of a property may be integrated with numerous security sensors and equipment. These sensors and equipment can be used to monitor all or a portion of a property, and include a connected knife block. The security system can leverage one or more machine learning models to analyze data collected by the sensors and equipment, e.g., to identify persons in the property who have removed a knife from the knife block or attempted to remove a knife from the knife block. The security system can receive data from the knife block that indicates a current state of the knife block, persons who have removed a knife from the knife block or attempted to remove a knife from the knife block, the presence of one or more knives in the knife block, the sharpness of one or more knives in the knife block, a state of charge of a battery of the knife block, etc. Based on the collected data and/or the outputs of the one or more machine learning models, the security system may determine one or more actions to perform. These actions may include, for example, to change the state of the knife block, and/or to generate and send a notification to an authorized user (e.g., an occupant or owner of the property).

The knife block includes a locking mechanism that is capable locking knives that are present in the knife block in place to prevent removal. The knife block may also include a number of sensors capable of detecting the presences of knives in the knife block. The knife block may also include a number of other sensors capable of detecting if the knives present in the knife block are dull. Additionally, the knife block may also include a camera to capture faces of persons who have removed knives from the knife block or have attempted to remove knives from the knife block.

The one or more machine learning models can be updated using input from one or more authorized users. The input may be requested by the security system. The input may be entered by an authorized user through an application on a computing device.

Figure 1:
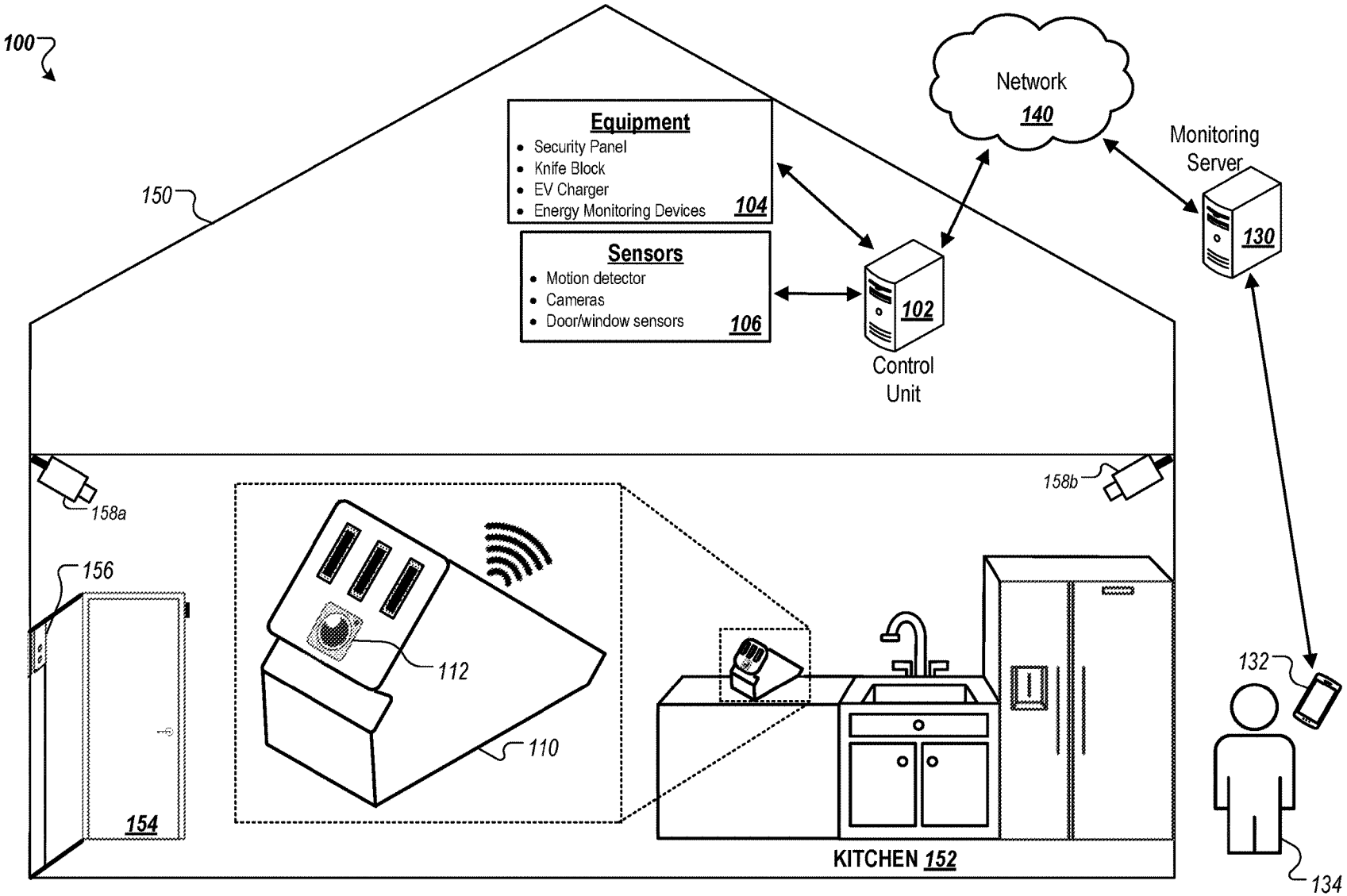
FIG. 1 is a diagram showing an example security monitoring system with a connected knife block.

FIG. 1 is a diagram showing an example security system 100 with a connected knife block 110. The system 100 includes a control unit 102, a monitoring server 130, security equipment 104, and security sensors 106. The equipment 104 and sensors 106 are installed at a property 150. Various components of the system 100 may communicate over a network 140.

The control unit 102 may include one or more computing devices. The control unit 102 may communicate with equipment 104 and sensors 106 through a wired and/or wireless connection. The control unit 102 may receive equipment and sensor output information from the equipment 104 and the sensors 106, respectively. The control unit 102 can communicate with the monitoring server 130 over the network 140. The control unit 102 may communicate with a computing device 132 of an authorized user 134, such as occupants of the property 150 in which the equipment 104 and the sensors 106 are installed. The control unit 102 may leverage one or more machine learning models to, for example, identify persons in the property 150, persons removing a knife from the knife block 110 or persons that have removed a knife from the knife block 110, and/or persons that have attempted to remove a knife from the knife block 110. The control unit 102 may send instructions to the knife block 110, such as instructions to change a state of the knife block 110 from an unlocked state to a locked state.

The sensors 106 may include, for example, one or more visible-light cameras such as the cameras 158*a* and 158*b*, infrared-light cameras (IR cameras), magnetic sensors/contact sensors (e.g., that are installed on one or more doors and/or windows) such as door sensor 156, motion detectors, temperature sensors, water sensors, accelerometers, Hall effect sensors, capacitive touch sensors, physical switches, inductive proximity sensors, etc.

The equipment 104 may include, for example, the knife block 110, one or more security panels, electronic vehicle chargers, energy monitoring devices, smart plugs, thermostats, smart HVAC system, smoke detectors, CO detectors, energy meters, smart locks, garage door controllers, etc. One or more pieces of equipment 104 may integrate or utilize one or more sensors of the sensors 106. For example, as will be discussed in more detail below, the knife block 110 includes a visible-light camera 112.

The monitoring server 130 may include one or more computing devices. The monitoring server 130 may also include one or more data storage devices. The monitoring server 130 may communicate with the control unit 102 and/or the computing device 132 of the authorized user 134. For example, the monitoring server 130 may receive sensor and/or equipment data from the control unit 102. The monitoring server 130 may leverage one or more machine learning models to, for example, identify persons in the property 150, persons removing a knife from the knife block 110 or persons that have removed a knife from the knife block 110, and/or persons that have attempted to remove a knife from the knife block 110. The monitoring server 130 may send instructions to the knife block 110, such as instructions to change a state of the knife block 110 from an unlocked state to a locked state.

The network 140 can include public and/or private networks and can include the Internet.

The property 150 includes a front door 154 and a kitchen 142 where the knife block 110 is located. The property 150 may be a residential property such as a house. The property 150 may be a commercial property such as a restaurant.

The authorized user 134 may be an owner or occupant of the property 150.

The computing device 132 may be, for example, a mobile phone, a smart phone, a tablet, a laptop computer, a desktop computer, or the like.

The disclosed techniques can improve the safety for the occupants of a given property in a number of ways. For example, an authorized user can lock the knife block, e.g., in person or through an application on their computing device, to prevent others, e.g., kids, from removing knives and possibly cutting themselves. In addition, the knife block may automatically lock knife block when certain events occur or situations are detected. For example, the knife block itself or the security system may determine, e.g., based on image data obtained from a camera on the knife block, that an unauthorized user is attempting to remove a knife, and, in response, automatically lock the knife block. Accordingly, an unauthorized user such as a child or an unknown person, e.g., a guest or criminal, may be prevented from removing a knife from the knife block. As another example, the knife block itself or the security system may determine, e.g., based on sensor data obtained from sensors in the knife block, that one or more knives in the knife block are dull, and, in response, automatically lock the knife block to prevent the one or more dull knives from being removed. This is to help prevent many kitchen accidents that arise as a result of persons using dull knives.

FIGS. 2A through 2D are diagrams showing examples of the connected knife block 110. The connected knife block 110 is an electronic knife holder that includes one or more electronic components. These components are discussed in more detail below and may include a microprocessor, sensors such as proximity sensors and/or contact sensors, and a transceiver. The connected knife block 110 may use the transceiver to communicate with one or more remote computing systems. The connected knife block 110 may also include in some implementations LEDs, push buttons, or a display with corresponding GUI (e.g., LCD display, LED display, OLED display, etc.).

In general, as depicted in FIGS. 2A through 2D, the connected knife block 110 can include a base member 160 that has multiple surfaces 162*a*-162*e*. The base member 160 may serve as a housing for one or more components of the connected knife block 110. For example, the base member 160 may house the electronics, such as a microprocessor, a transceiver, and various wires for electrically coupling the microprocessor to the transceiver and to various sensors of the connected knife block 110. Similarly, the base member 160 may include one or more cavities. These cavities may include, for example, cavities configured to receive one or more knives or one or more knife inserts (e.g., replicable plastic inserts that themselves include slots configured to receive one or more knives). Similarly, the base member 160 may house all or a portion of a lock used to lock one or more knives inserted into the connected knife block 110.

The base member 160 may include a first surface 162*a*. The first surface 162*a* may be a face surface of the connected knife block 110. This first surface 162*a* may include one or more openings that are configured to receive knife inserts or knives directly. The base member 160 may include a second surface 162*b*. The second surface 162*a* may be a side surface of the connected knife block 110. As described in more detail with respect to FIG. 3A, a housing 330 that houses a locking mechanism (e.g., a lock configured to lock one or more knives in the connected knife block 110) may be connected to the second surface 162*b* of the base member 160. The base member 160 may include a third surface 162*c*. The third surface 162*c* may be a side surface of the connected knife block 110. As described in more detail with respect to FIG. 3A, the housing 330 that houses a locking mechanism (e.g., a lock configured to lock one or more knives in the connected knife block 110) may be connected to the third surface 162*c* of the base member 160. The base member 160 may include a fourth surface 162*d*. The fourth surface 162*d* may be a front or forward surface of the connected knife block 110. The base member 160 may include a fifth surface 162*e*. The fifth surface 162*e* may be an interactive surface of the connected knife block 110. As described below with respect to FIGS. 2A-2D, the fifth surface 162*e* may have buttons or a display embedded in the fifth surface 162*e* that allow a user to interact with the connected knife block 110.

The base member 160 of the connected knife block 110 may include one or more additional surfaces. For example, the base member 160 may include one or more rear surfaces.

Various components of the connected knife block 110 may be disposed in one or more of the surfaces 162*a*-162*e* of the base member 160, or otherwise coupled to the base member 160. For example, the camera 112 may be disposed in the first surface 162*a* of the connected knife block 110*a* described in more detail below. Similarly, various sensors 118*a*-118*c* (e.g., used to detect if a knife is present in various openings formed in the first surface 162*a* of the base member 160) may be disposed in the first surface 162*a* of the connected knife block 110*a*. The sensors 118*a*-118*c* may be secured using one or more layers of glue or resin. For example, the sensors 118*a*-118*c* may be embedded in epoxy resin placed in recesses of the first surface 162*a*.

Figure 2A:
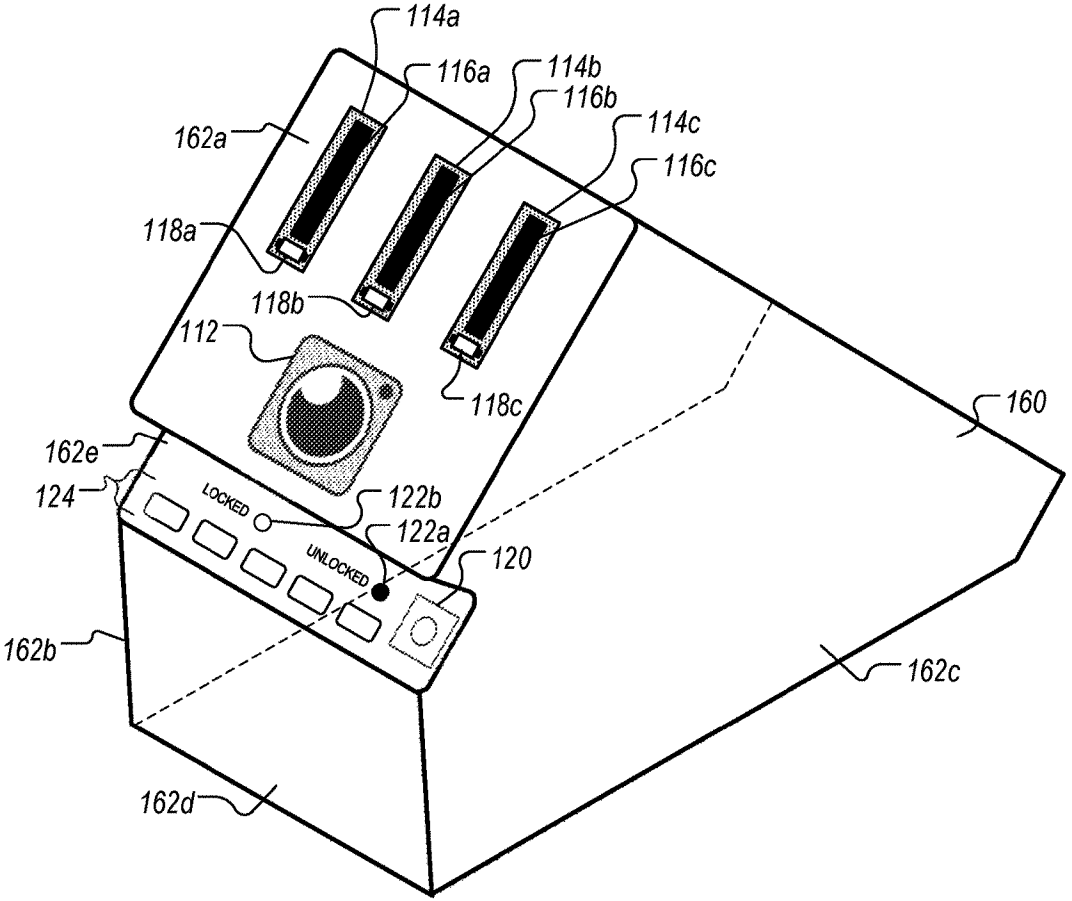
FIGS. 2A through 2D are diagrams showing examples of a connected knife block.

FIG. 2A shows a first embodiment of the connected knife block 110*a*. The knife block 110*a* includes the camera 112, openings 116*a*-116*c* (e.g., knife slots) that are formed in inserts 114*a*-114*c* respectively, the sensors 118*a*-118*c* to detect the presence of a knife in the openings 116*a*-116*c* respectively, a keypad 124, a lock/unlock button 120, an unlocked indicator 122*a*, and a locked indicator 122*b*. The openings 116*a*-116*c* are each designed to receive a single knife.

The sensors 118*a*-118*c* may be magnetic/contact sensors that are each triggered when they come into contact with or close proximity to a magnet coupled to a corresponding knife. The sensors 118*a*-118*c* may be Hall effect sensors that each detect when a magnet coupled to a corresponding knife is in close proximity. The sensors 118*a*-118*c* may be inductive proximity sensors that each detect when the metal of a knife (such as the bolster of a knife) is in close proximity. When the sensors 118*a*-118*c* are inductive proximity sensors, the corresponding knives need not have magnets coupled to them.

The keypad 124 includes five buttons that allow a user to enter a code to, for example, change the state of the knife block from a locked state to an unlocked state. The code may be set by the authorized user 134, e.g., upon initial setup of the knife block 110*a* or through an application on their computing device 132. The five buttons may each be labelled with and correspond to, for example, a number (e.g., numbers one through five) or a letter (e.g., letters A through E). In some implementations, the keypad 124 includes more than five buttons. In other implementations, the keypad 124 includes less than five buttons. The buttons of the keypad 124 may be physical buttons (e.g., mechanical switches, membrane switches, or the like). The buttons of the keypad 124 may be capacitive touch buttons.

The lock/unlock button 120 may be a physical buttons, e.g., a mechanical switch, a membrane switch, or the like. The lock/unlock button 120 may be a capacitive touch button. When a user presses the lock/unlock button 120 while the knife block is in an unlocked state, the knife block 110*a* will change to a locked state, e.g., the knife block 110*a* will actuate a locking mechanism to lock the knives that are present in the knife block 110*a* in place. In some implementations, if no knives are present in the knife block 110, the knife block 110 will not change to a locked state. In some implementations, a user will be prevented from using the lock/unlock button 120 to place the knife block 110*a* in an unlocked state until the user has entered a particular code through the keypad 124, or until the knife block 110*a* or the system 100 has identified the user using image data obtained from the camera 112 or from one or more other cameras (e.g., the cameras 158*a* and/or 158*b* shown in FIG. 1) and determined that the user is an authorized user.

The unlocked indicator 122*a* and the locked indicator 122*b* may each be an LED. The unlocked indicator 122*a* lights up when the knife block 110*a* is in an unlocked state as shown. The locked indicator 122*b* lights up when the knife block 110*b* is in a locked state.

The inserts 114*a*-114*c* may be made from a different material than the body of the knife block 110*a*. For example, the inserts may be made out of plastic while the body of the knife block 110*a* is made from wood. The inserts 114*a*-114*c* may be removable and may contain sensors, in addition to the sensors 118*a*-118*c* respectively, as detailed in more detail below with respect to FIGS. 4A-4E.

In some implementations, the knife block 110 does not include the inserts 114*a*-114*c*. Instead, the knife block 110 the multiple openings (e.g., slots) of the knife block 110 may be configured to receive one or more knives instead of inserts. For example, the openings 116*a*-116*c* may be formed in the base member 160 of the knife block 110.

In some implementations, the openings 116*a*-116*c* are the same as one another, e.g., they are each designed to receive the same knife or the same type of knife. In some implementations, the openings 116*a*-116*c* are each different from one another, e.g., they are each designed to receive a different knife or a different type of knife (e.g., to account for knives of different lengths, different depths, etc.).

Figure 2B:
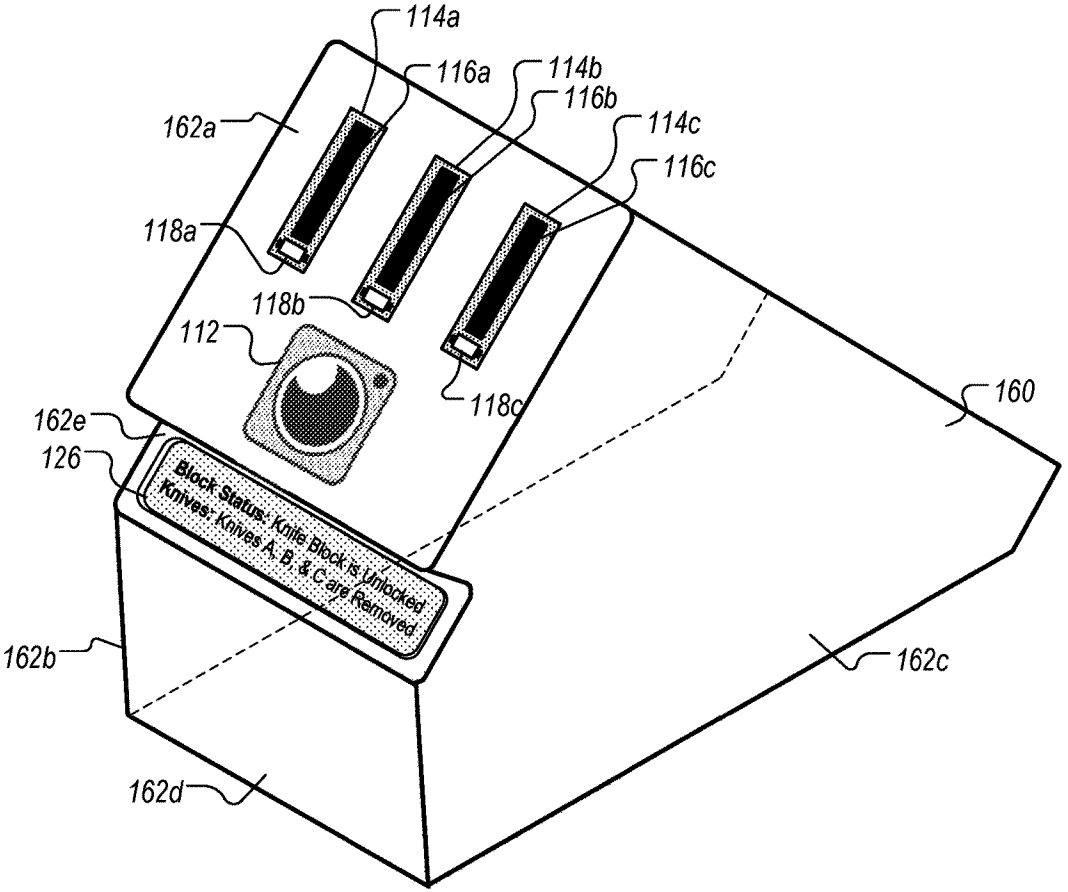

FIG. 2B shows a second embodiment of the connected knife block 110*b*. The knife block 110*b* includes the camera 112, the openings 116*a*-116*c* that are formed in the inserts 114*a*-114*c* respectively, the sensors 118*a*-118*c* to detect the presence of a knife in the openings 116*a*-116*c* respectively, and a touchscreen display 126.

The touchscreen display 126 may indicate the state of the knife block 110*b*. For example, as shown, the touchscreen display 126 indicates that the "Knife Block is Unlocked." The touchscreen display 126 may also indicate information associated with the knives of the knife block 110*b*. For example, the touchscreen display 126 may indicate which knives are present (e.g., "Knives A, B, & C [corresponding to openings 116*a*, 116*b*, and 116*c* respectively] are removed"), and/or may indicate which knives are dull.

A user may use the touchscreen display 126 to change the state of the knife block 110*b*. For example, the touchscreen display 126 may display a digital keypad which a user may use to enter a code to unlock the knife block 110*b*. The touchscreen display 126 may display a digital lock/unlock button which a user may use to lock and/or unlock the knife block 110*b*. Alternatively, in some implementations, the knife block 110*b* includes the keypad 124 and/or the lock/unlock button 120 in addition a display. The display does not necessarily need to be a touchscreen display.

The touchscreen display 126 may be an LCD display. The touchscreen display 126 may be an LED display.

Figure 2C:
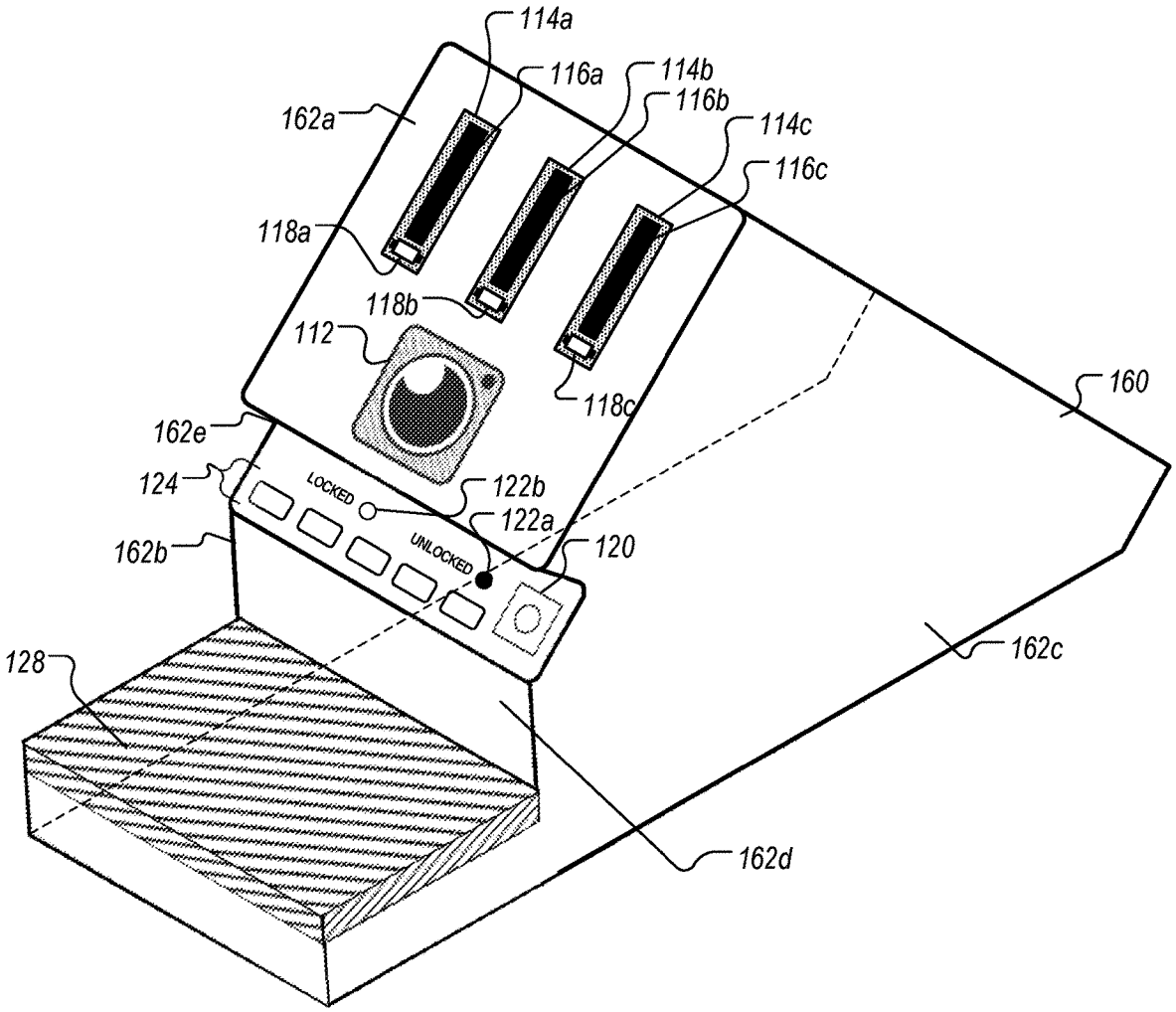

FIG. 2C shows a third embodiment of the connected knife block 110*c*. The knife block 110*c* includes the camera 112, the openings 116*a*-116*c* that are formed in the inserts 114*a*-114*c* respectively, the sensors 118*a*-118*c* to detect the presence of a knife in the openings 116*a*-116*c* respectively, the keypad 124, the lock/unlock button 120, the unlocked indicator 122*a*, the locked indicator 122*b*, and a sharpening block 128. The knife block 110*c* may include the touchscreen display 126 shown in FIG. 2B, e.g., in place of the keypad 124, the unlocked indicator 122*a*, and the locked indicator 122*b*.

The sharpening block 128 allows a user to sharpen knives including those that the knife block 110*c* is designed to receive. The system 100 (e.g., the control unit 102 or the monitoring server 130) may monitor the user using the camera 112 on the knife block 110*c* and/or using the cameras 158*a*-158*b* to keep track of how often the knives of the knife block 110*c* are being sharpened. In some implementations, as will be discussed in more detail below with respect to FIGS. 4A-4E, the system 100 (e.g., the control unit 102 or the monitoring server 130) may use this information to estimate the sharpness of the knives of the knife block 110*c*. The system 100 (e.g., the control unit 102 or the monitoring server 130) may monitor the user using the camera 112 on the knife block 110*c* and/or using the cameras 158*a*-158*b* to ensure that the user sharpens a knife that is determined to be dull.

For example, as will be described in more detail below with respect to FIG. 6F, the knife block 110*c* may be automatically locked, e.g., by the knife block 110*c* itself or by the system 100 (e.g., the control unit 102 or the monitoring server 130), when it is determined that that one or more knives in the knife block 110*c* are dull, e.g., when sensor data indicates that the one or more knives in the knife block 110*c* are dull. The control unit 102 or the monitoring server 130 may notify the user that one or more knives are dull through a notification sent to a computing device of the user, and/or through a display on the knife block 110*c*. The user may have to acknowledge the notification in order to unlock the knife block 110*c*. Upon acknowledgement of the notification, e.g., through one or more touch inputs made through a computing device of the user or through a display of the knife block 110*c*, the knife block 110*c* is unlocked, allowing the user to remove the knives that are present in the knife block 110*c*. Upon removal of the dull knife by the user, e.g., as indicated by one of the sensors 118*a*-118*c*, the monitoring server 130 may instruct the knife block 110*c* (e.g., through the control unit 102) to turn on the camera 112 and to stream image data to the monitoring server 130, and/or to the control unit 102 which, in turn, passes the image data to the monitoring server 130. Based on the received image data, the monitoring server 130 determines whether or not the user is sharpening the dull knife using the sharpening block 128.

If the monitoring server 130 determines that the user has not sharpened the dull knife using the sharpening block 128 (or using another sharpening block or device), the monitoring server 130 may generate and send a notification to a computing device of the user and/or send instructions to the knife block 110*c* to present a notification on a display of the knife block 110*c*. The notification may indicate that the user should immediately sharpen the knife or place it back in the knife block 110*c*. If the user reinserts the dull knife in the knife block 110*c* without sharpening it, the monitoring server 130 may send instructions to the knife block 110*c* to lock the knife block 110*c*.

Figure 2D:
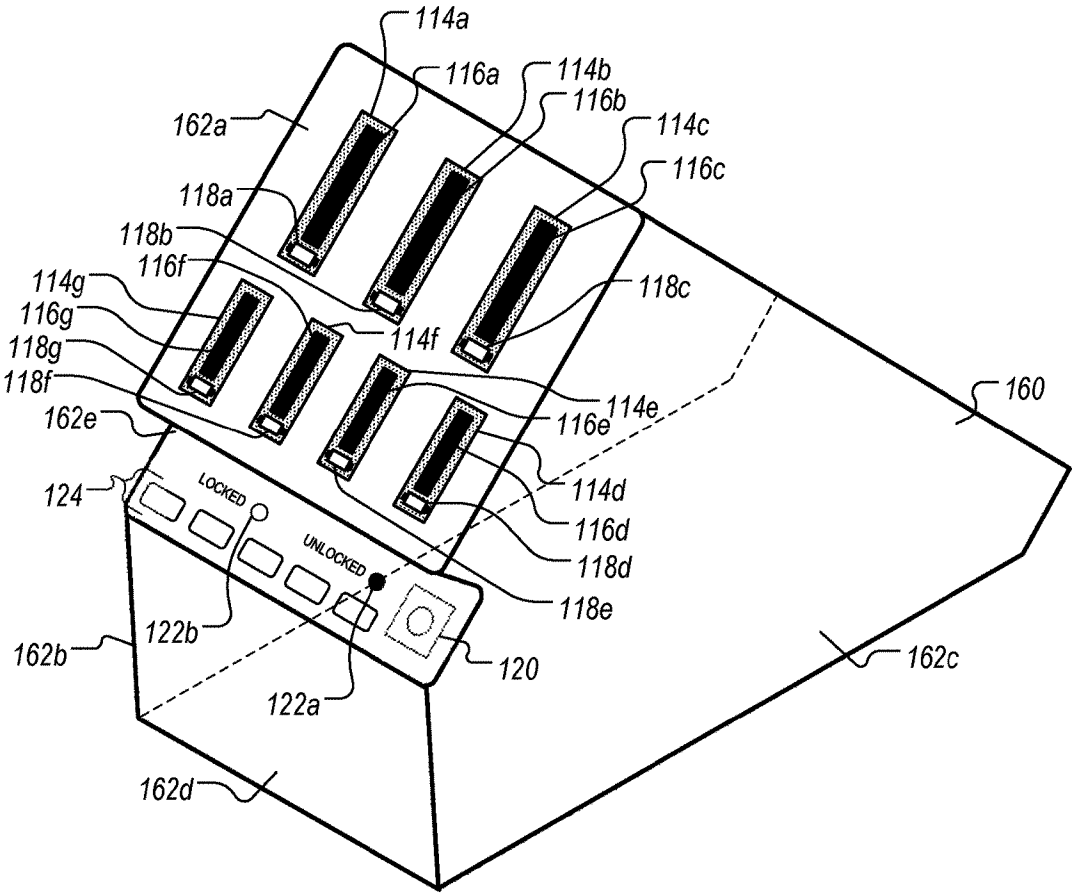

FIG. 2D shows a fourth embodiment of the connected knife block 110*d*. The knife block 110*d* includes the camera 112, the openings 116*a*-116*c* that are formed in the inserts 114*a*-114*c* respectively, the sensors 118*a*-118*c* to detect the presence of a knife in the openings 116*a*-116*c* respectively, the keypad 124, the lock/unlock button 120, the unlocked indicator 122*a*, the locked indicator 122*b*, additional opening 116*d*-*g* that are formed in additional inserts 114*d*-114*g* respectively, and additional sensors 118*d*-118*g*. The knife block 110*d* may include the touchscreen display 126 shown in FIG. 2B, e.g., in place of the keypad 124, the unlocked indicator 122*a*, and the locked indicator 122*b*. The openings 116*d*-116*g* are each designed to receive a single knife.

As shown, the openings 116*d*-116*g* may be a different size than the openings 116*a*-116*c*. For example, the openings 116*d*-116*g* may be smaller than the openings 116*a*-116*c* and designed to receive smaller knives that the openings 116*a*-116*c*.

In some implementations, the openings 116*d*-116*g* are the same as one another, e.g., they are each designed to receive the same knife or the same type of knife. In some implementations, the openings 116*d*-116*g* are each different from one another, e.g., they are each designed to receive a different knife or a different type of knife.

Figure 3A:
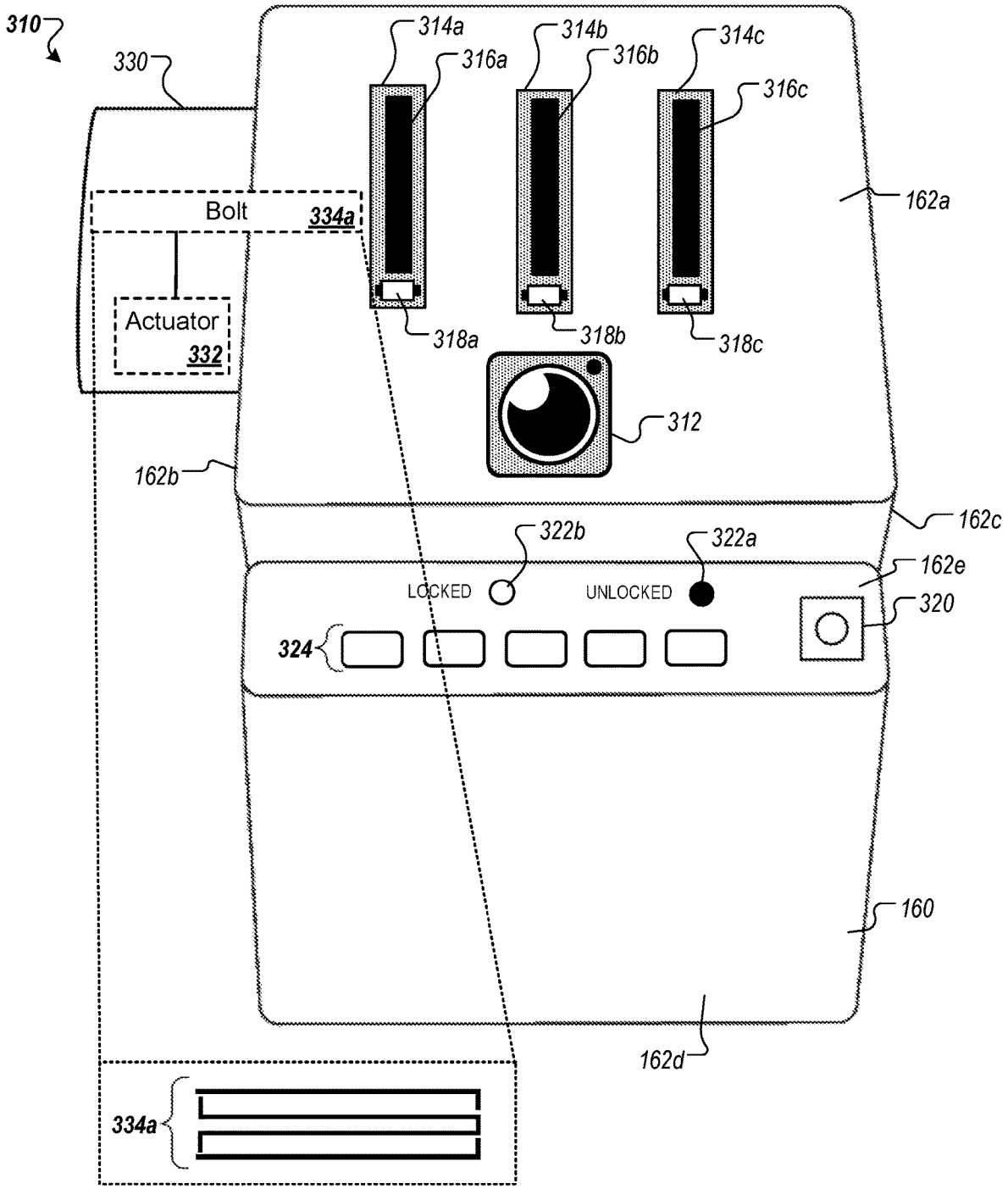
FIGS. 3A and 3B are diagrams showing examples of a connected knife block.
Figure 3B:
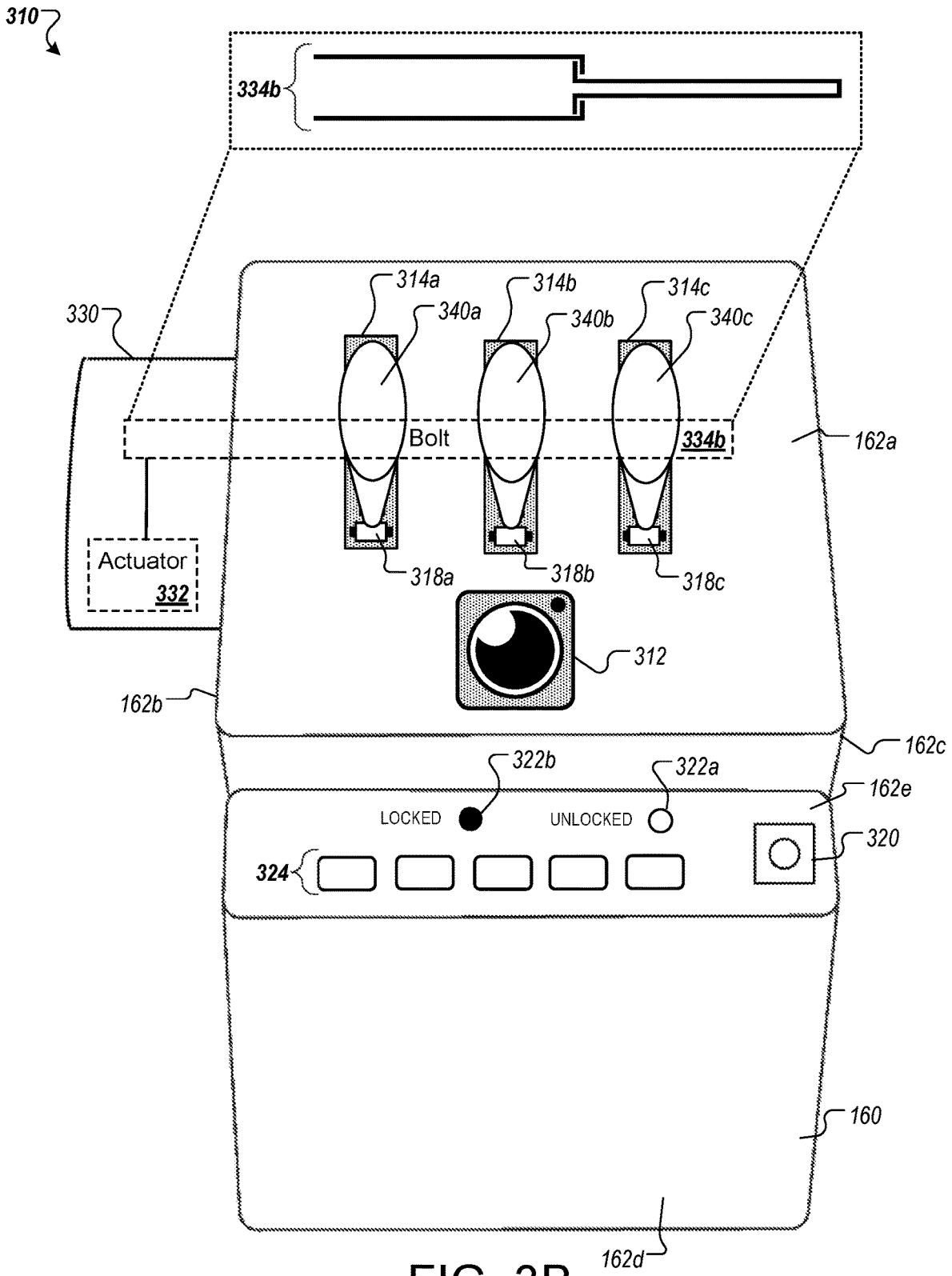

FIGS. 3A and 3B are diagrams showing examples of a connected knife block 310. In some implementations, the knife block 310 is the knife block 110 shown in FIGS. 1 and 2A-2D.

FIG. 3A shows the knife block 310 in an unlocked state. The knife block 310 includes a camera 312, openings 316*a*-316*c* that are formed in inserts 314*a*-314*c* respectively, sensors 318*a*-318*c* to detect the presence of a knife in the openings 316*a*-316*c* respectively, a keypad 324, a lock/unlock button 320, an unlocked indicator 322*a*, a locked indicator 322*b*, an actuator 332 within a housing 330 of the knife block 310, and a telescoping bolt 334*a* in a compact/unlocked position. The openings 316*a*-316*c* are each designed to receive a single knife.

The sensors 318*a*-318*c* may be magnetic/contact sensors that are each triggered when they come into contact with or close proximity to a magnet coupled to a corresponding knife. The sensors 318*a*-318*c* may be Hall effect sensors that each detect when a magnet coupled to a corresponding knife is in close proximity. The sensors 318*a*-318*c* may be inductive proximity sensors that each detect when the metal of a knife (such as the bolster of a knife) is in close proximity. When the sensors 318*a*-318*c* are inductive proximity sensors, the corresponding knives need not have magnets coupled to them. The sensors 318*a*-318*c* may be the sensors 118*a*-118*c* shown in FIGS. 2A-2D.

As shown, the knife block 310 is currently in an unlocked state as indicated by unlocked indicator 322*a* and by the bolt 334*a* being in a compact/unlocked position.

The knife block 310 may automatically revert to an unlocked state when all of the knives are removed as is the case in FIG. 3A. This may help to prevent a user from damaging or dulling a knife if they forget to unlock the knife block 310 before replacing the knife. Similarly, in some implementations, the knife block 310 will automatically be unlocked if the user is identified as an authorized user. For example, if the monitoring server 130 identifies a user approaching the knife block 310 as an authorized user based on image data collected from the camera 312, then the monitoring server 130 may send instructions to the knife block 310 to unlock the knife block 310 before the user attempts to replace the knife. This may again help prevent knives from being damaged or dulled.

FIG. 3B shows the knife block 310 in a locked state. The knife block 310 includes a camera 312, openings 316*a*-316*c* that are formed in inserts 314*a*-314*c* respectively, sensors 318*a*-318*c* to detect the presence of a knife in the openings 316*a*-316*c* respectively, a keypad 324, a lock/unlock button 320, an unlocked indicator 322*a*, a locked indicator 322*b*, an actuator 332 within a housing 330 of the knife block 310, and a telescoping bolt 334*a* in a compact/unlocked position. The openings 316*a*-316*c* are each designed to receive a single knife.

As shown, knives 340*a*-340*c* have been placed in the openings 316*a*-316*c* respectively. Also, the knife block 310 is currently in an unlocked state as indicated by unlocked indicator 322*a* and by the bolt 334*a* being in a compact/unlocked position.

Locking of the knife block 310 may have been triggered automatically, e.g., by the monitoring server 130 sending instructions to the knife block 310 in response to the system 100 being armed, or manually, e.g., after the user has pressed the lock/unlock button 320. In response to this triggering event, the actuator 332 causes the bolt 334*b* to change from a compact/unlocked position as shown in FIG. 3A to an extended/locked position. As shown, the bolt 334*b* telescopes and passes through holes in each of the knives 340*a*-340*c*, thereby locking them in the knife block 310.

In some implementations, the knife block 310 uses one or more non-telescoping bolts to lock the knives 340*a*-340*c* in place. For example, the knife block 310 may use a longer non-telescoping bolt that requires a wider housing 330 or the knife block 310 to have a wider body. As another example, the knife block 310 may use multiple non-telescoping bolts, e.g., a first non-telescoping bolt on the left side of the knife block 310 partially located in the housing 330 and a second non-telescoping bolt on the right side of the knife block 310 partially located in a second housing. The two non-telescoping bolts may be different in length such that, for example, the first non-telescoping bolt is capable of passing through and locking the knives 340*a*-340*b* and the second non-telescoping bolts is capable of passing through and locking the knife 340*c*.

FIGS. 4A through 4E are diagrams showing examples of the connected knife block 410. In some implementations, the knife block 410 is the knife block 110 shown in FIGS. 1 and 2A-2D. In some implementations, the knife block 410 is the knife block 310 shown in FIGS. 3A-3B.

Figure 4A:
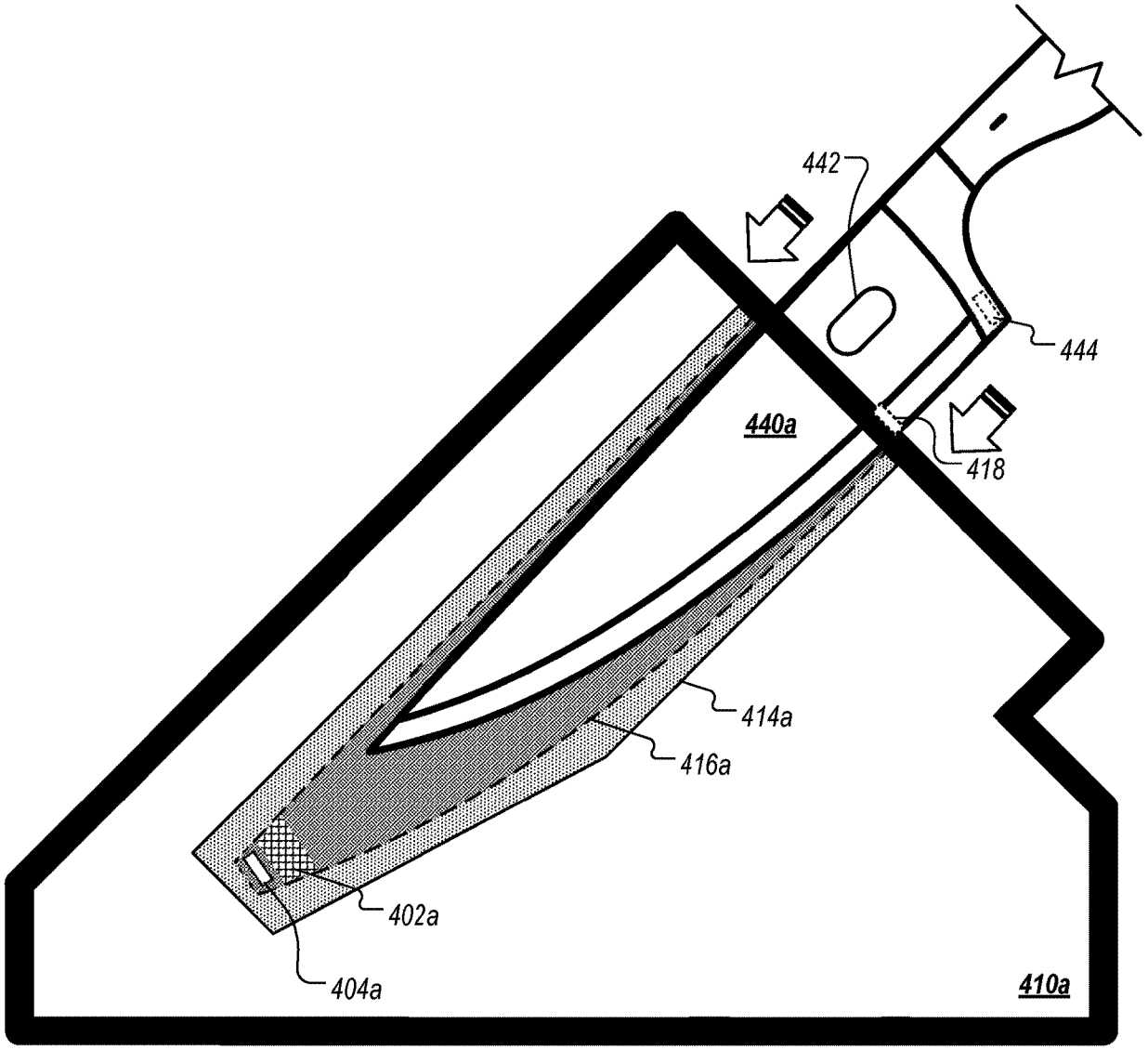
FIGS. 4A through 4E are diagrams showing examples of a connected knife block.

FIG. 4A shows a knife 440*a* being inserted into the knife block 410*a*. The knife block 410*a* includes an insert 414*a*, an opening 416*a* formed in the insert 414*a*, a sensor 404*a* within the opening 416*a*, and a piece of material 402*a*. The opening 416*a* may be designed to receive the knife 440*a*.

The knife 440*a* includes a blade that defines a passageway 442. The passageway 442 allows the bolt 334 shown in FIGS. 3A-3B to pass through the knife 440*a* when the knife block 410*a* receives the knife 440*a* and the knife block 410*a* is placed in a locked state, thereby locking the knife 440*a* into place. As will be discussed in more detail below with respect to FIGS. 4B and 4D, in some implementations, the passageway 442 may be oval, elliptical, or stadium in shape (e.g., instead of circular) to allow the bolt 334 to pass through the knife 440*a* when the knife 440*a* cuts through the piece of material 402*a* and when the knife 440*a* fails to cut through the piece of material 402*a*. The oval, elliptical, or stadium shape of the passageway, like a circle, would also allow for the blade for the knife 440*a* to maintain its structural integrity.

The knife 440*a* also optionally includes a magnet 444 that may interact with a sensor 418. The sensor 418 may be one of the sensors 118*a*-118*c* shown in FIGS. 2A-2D. The sensor 418 may be one the sensors 318*a*-318*c* shown in FIGS. 3A-3B. The sensor 418 may be a magnetic/contact sensor that is triggered when it comes into contact with or close proximity to the magnet 444 of the knife 440*a*. The sensor 418 may be a Hall effect sensor that detects when the magnet 444 of the knife 440*a* is in close proximity. The sensor 418 may be an inductive proximity sensor that detects when the metal of the knife 440*a* (such as the bolster of a knife) is in close proximity. When the sensor 418-118*c* is an inductive proximity sensor, the knife 440*a* may not have the magnet 444.

The piece of material 402*a* may be made from a synthetic or natural polymer such as rubber. The piece of material 402*a* may be made from a self-healing material capable of recovering, to at least a certain extent, after it is cut, e.g., by the knife 440*a*. The piece of material 402*a* may be divided into two halves such that a first half of the piece of material 402*a* comes into contact with substantially the left side of the knife 440*a*'s edge and/or blade, and a second half of the piece of material 402*a* comes into contact with substantially the right side (not shown) of the knife 440*a*'s edge and/or blade. The material that forms the piece of material 402*a* and/or the thickness of the piece of material 402*a* may be selected such that the knife 440*a* is capable of cutting or passing through the piece of material 402*a* only when it is sufficiently sharp. For example, the material that forms the piece of material 402*a* may be selected due to having a certain coefficient of friction with respect to steel or stainless steel that, for a given thickness of the material, allows the knife 440*a* to pass or cut through the piece of material 402*a* when it is sharp and prevents the knife 440*a* from passing or cutting through the piece of material 402*a* when it is dull.

The piece of material 402*a* may be secured to the insert 414*a*, e.g., by glue and/or by formations in the insert 414*a*.

In some implementations, as will be discussed in more detail below with respect to FIG. 4E, the knife block 410*a* may include additional pieces of material or one or more pieces of material placed at different positions within in the opening 416*a* to, for example, assist in detecting the sharpness of other locations of the edge of the knife 440*a*.

The sensor 404*a* may be a switch, such as a mechanical switches or a membrane switch, that is physically actuated by the tip of the knife 440*a* once it passes or cuts through the piece of material 402*a*. The sensor 404*a* may be a touch sensor, such as a capacitive touch sensor, that detects when the tip of the knife 440*a* comes into contact it after the knife 440*a* passes or cuts through the piece of material 402*a*. The sensor 404*a* may be an inductive proximity sensor that is capable of detecting when the knife 440*a* comes into close proximity, e.g., when the knife 440*a* has passed or cut through the piece of material 402*a*.

The sensor 404*a* may be secured to the insert 414*a*, e.g., by glue and/or by formations in the insert 414*a*.

In some implementations, as will be discussed in more detail with respect to FIG. 4E, more than a single sensor may be used to detect the sharpness of the knife 440*a*.

Figure 4B:
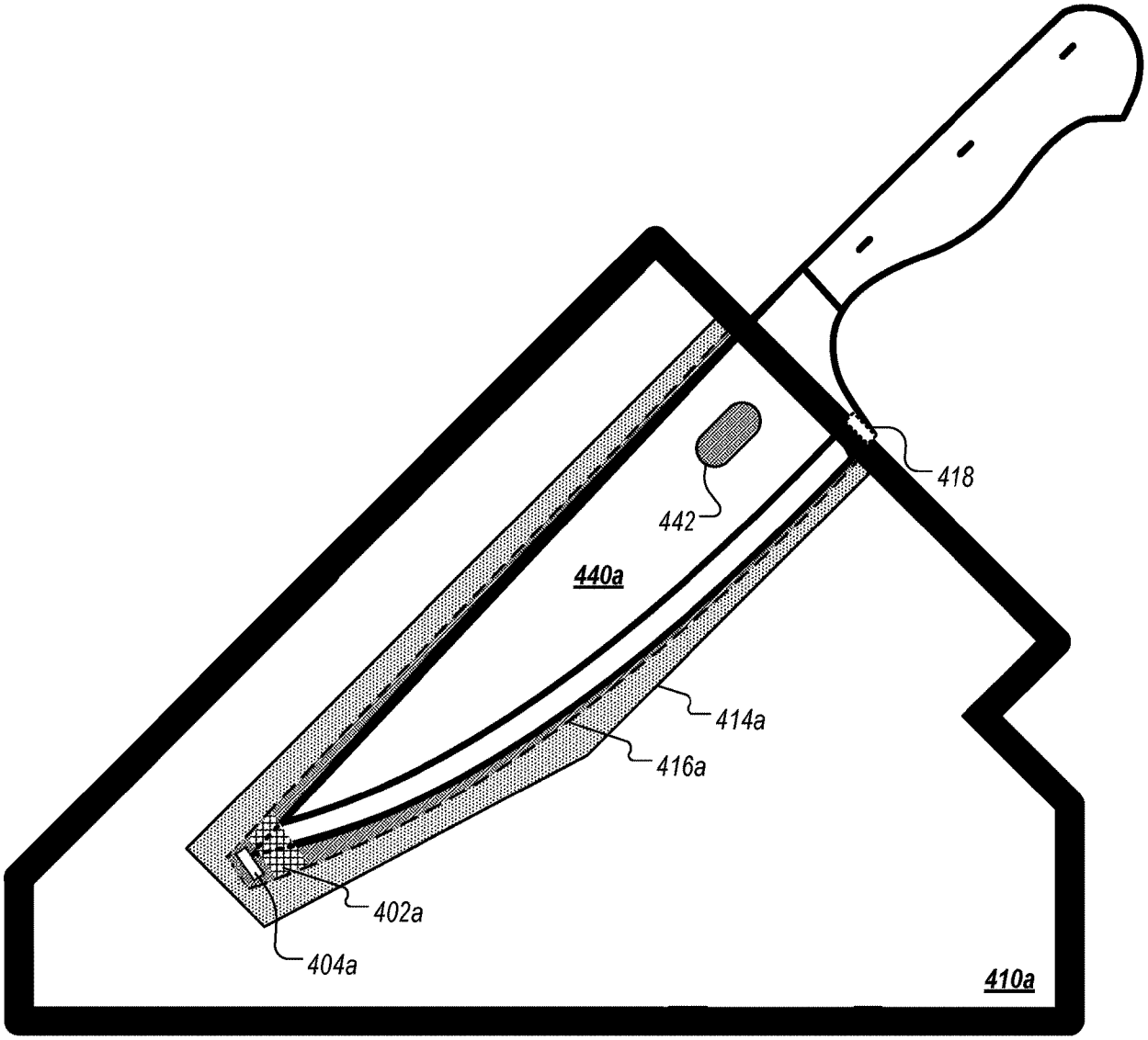

FIG. 4B shows the knife 440*a* fully inserted into the knife block 410*a*. As shown, the tip of the knife 440*a* has cut or passed through the piece of material 402*a*, indicating that the knife 440*a* is sufficiently sharp. The knife 440*a* has come into contact with or close proximity to the sensor 404*a*, which may generate an output indicating the contact or close proximity.

Figure 4C:
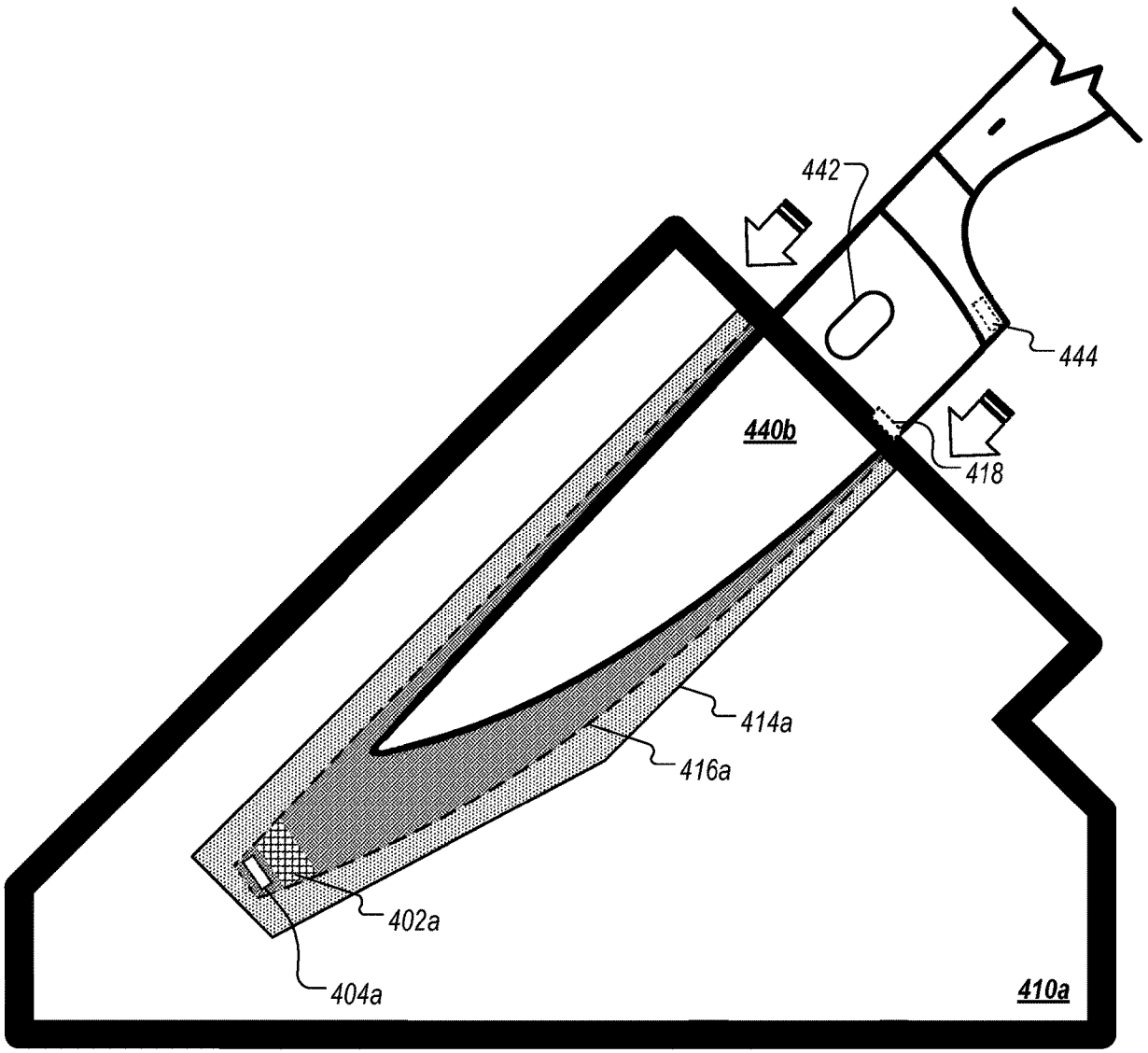

FIG. 4C shows a knife 440*b* being inserted into the knife block 410*a*. As depicted, the knife 440*b* is dull.

Figure 4D:
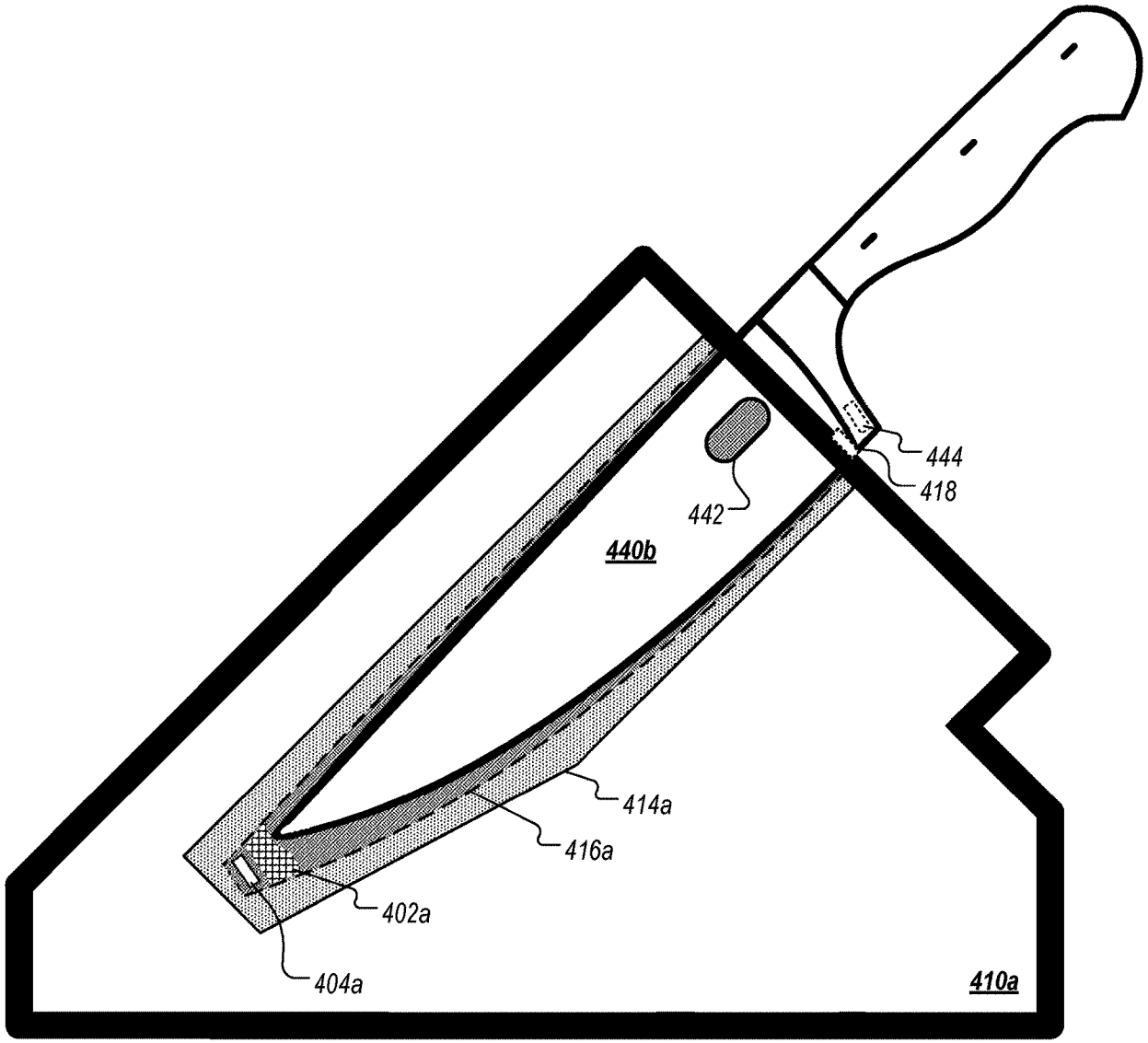

FIG. 4D shows the knife 440*b* inserted into the knife block 410*a*. As shown, the tip of the knife 440*b* has not cut or passed through the piece of material 402*a*, indicating that the knife 440*b* is indeed dull. Accordingly, any output produced by the sensor 404*a* would only indicate that the knife 440*b* has not contacted the sensor 404*a* and/or has not come into close proximity of the sensor 404*a*.

Figure 4E:
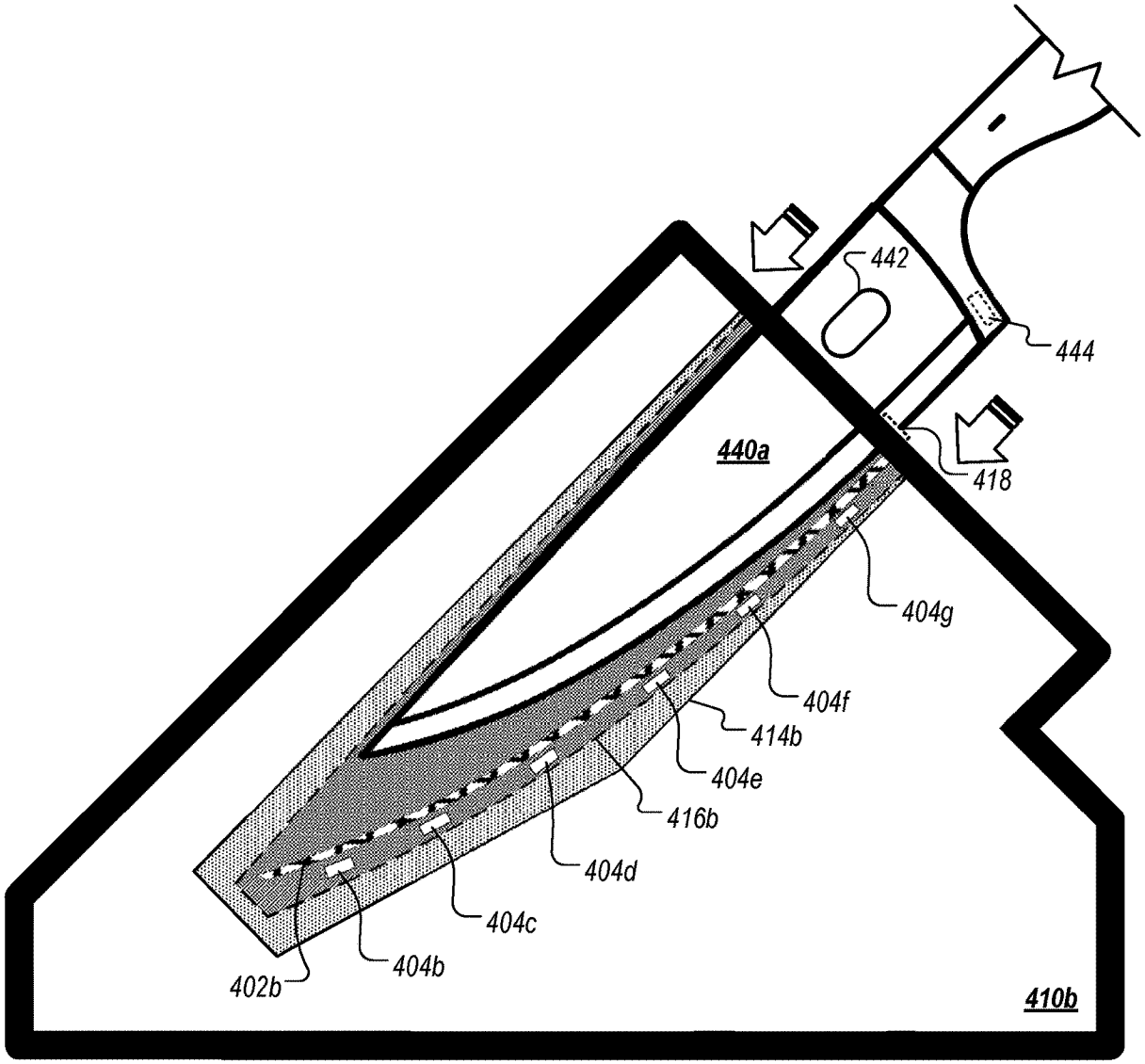

FIG. 4E shows the knife 440*a* being inserted into a knife block 410*b*. The knife block 410*b* includes an insert 414*b*, an opening 416*b* formed in the insert 414*b*, sensors 404*b*-404*g* within the opening 416*a*, and a piece of material 402*b*. The opening 416*b* may be designed to receive the knife 440*a*.

The piece of material 402*b* may be made from a synthetic or natural polymer such as rubber. The piece of material 402*b* may be made from a self-healing material capable of recovering, to at least a certain extent, after it is cut, e.g., by the knife 440*a*. The piece of material 402*b* may be divided into two halves such that a first half of the piece of material 402*b* comes into contact with substantially the left side of the knife 440*a*'s edge and/or blade, and a second half of the piece of material 402*b* comes into contact with substantially the right side (not shown) of the knife 440*a*'s edge and/or blade. The material that forms the piece of material 402*b* and/or the thickness of the piece of material 402*b* may be selected such that the knife 440*a* is capable of cutting or passing through the piece of material 402*b* only when it is sufficiently sharp. For example, the material that forms the piece of material 402*b* may be selected due to having a certain coefficient of friction with respect to steel or stainless steel that, for a given thickness of the material, allows the knife 440*a* to pass or cut through the piece of material 402*b* when it is sharp and prevents the knife 440*a* from passing or cutting through the piece of material 402*b* when it is dull.

The piece of material 402*b* may be secured to the insert 414*b*, e.g., by glue and/or by formations in the insert 414*b*.

The sensors 404*b*-404*g* may be switches, such as mechanical switches or a membrane switches, that are physically actuated by the edge of the knife 440*a* once it passes or cuts through the piece of material 402*b*. The sensors 404*b*-404*g* may be touch sensors, such as capacitive touch sensors, that detect when the edge of the knife 440*a* comes into contact them after the knife 440*a* passes or cuts through the piece of material 402*b*. The sensors 404*b*-404*g* may be inductive proximity sensors that are capable of detecting when the knife 440*a* comes into close proximity, e.g., when the knife 440*a* has passed or cut through the piece of material 402*b*. The sensors 404*b*-404*g* may be a combination of switches, touch sensors, and/or inductive proximity sensors.

The sensors 404*b*-404*g* may be secured to the insert 414*b*, e.g., by glue and/or by formations in the insert 414*b*.

In some implementations, the knife block 410 includes the piece of material 402*a* to assist in detecting a sharpness of the edge of the knife 440 corresponding to the tip of the knife, and the piece of material 402*b* to assist in detecting the sharpness of other parts of the edge of the knife 440. The knife block 410 can include the sensors 404*a*-404*g* for detecting the sharpness of the edge of the knife 440. The knife block 410 can include less or additional sensors for detecting the sharpness of the edge of the knife 440.

In some implementations, the system 100 (e.g., the control unit 102 or the monitoring server 130) estimates the sharpness of the knife 440 without relying on the sensors 404*a* and/or the sensors 404*b*-404*g*, e.g., as may be the case if the knife block 410 does not contain the sensors 404*a* and/or the sensors 404*b*-404*g* for detecting the sharpness of a knife or if one or more of the sensors 404*a* and/or the sensors 404*b*-404*g* fail. For example, in estimating the sharpness of the knife 440, the monitoring server 130 may take into account the following: how often the knife 440 has been removed, e.g., using data from the sensor 418 and/or image data from the camera 112, which can indicate how much use the knife 440 has received; how long the knife 440*a* has been removed for, e.g., by comparing times corresponding to when data from sensor 418 indicated the knife 440 was removed from the knife block 410 with times corresponding to when data from sensor 418 indicated that the knife 440 was replaced, which can again indicate how much use the knife 440 has received; the amount of time that has passed since the knife 440 was last sharpened, e.g., determined using image data collected from the cameras 112 and/or 158*a*-158*b*; how often the knife 440 has been removed since it was last sharpened; how long the knife 440 has been removed for since it was last sharpened; and/or how long the knife 440 was sharpened for during one or more of its most recent sharpening sessions, e.g., determined using image data collected from the cameras 112 and/or 158*a*-158*b*.

As another example, the system 100 (e.g., the control unit 102 or the monitoring server 130) can estimate the sharpness of the knife 440*a* without the sensors 404*a* and/or the sensors 404*b*-404*g* by determining whether the knife 440 passed or cut through the piece of material 402*a* and/or the piece of material 402*b* using the sensor 418. For example, where the sensor 418 is able to detect proximity, the sensor 418 may provide outputs that correspond with a first range of values indicating the knife 440 is fully inserted into the knife block 410, and, therefore, has cut or passed through the piece of material 402*a* and/or the piece of material 402*b*. The sensor 418 may also provide outputs that correspond with a second range values indicating the knife 440 is not fully inserted into the knife block 410, and, therefore, has failed to cut or pass through the piece of material 402*a* and/or the piece of material 402*b*. Accordingly, the knife block 410 or the system 100 (e.g., the control unit 102 or the monitoring server 130) may compare an output of the sensor 418 with the first range and/or second range of values. Based on this comparison, the knife block 410 or the system 100 (e.g., the control unit 102 or the monitoring server 130) may determine that the knife 440 is sharp if the output of the sensor 418 is in the first range of values, or may determine that the knife 440 is dull if the output of the sensor 418 is in the second range of values.

In some implementations, the system 100 (e.g., the control unit 102 or the monitoring server 130) determines the sharpness of the knife 440 using the sensor 404*a* and/or the sensors 404*b*-404*g*, and proceeds to confirm the determined sharpness of the knife 440 using data other than that collected by the sensor 404*a* and/or the sensors 404*b*-404*g*. For example, the monitoring server 130 may determine based on data from the sensors 404*b*-404*g* that the knife 440 is sharp. The monitoring server 130 may then analyze data from sensor 418, image data from the camera 112, and/or image data from the camera 158*a* and/or the camera 158*b*. In analyzing this data, the monitoring server 130 may determine that the knife 440 was recently sharpened and that it has not been removed often or for long periods of time since being sharpened. Based on this determination, the monitoring server 130 confirms that the knife 440 is sharp and will not send instructions to the knife block 410 to lock the knife block 410 due to the dullness of the knife 440.

Alternatively, in analyzing the data collected from the sensor 418, the camera 112, and/or the camera 158*a* and/or the camera 158*b*, the monitoring server 130 may determine that the knife 440 has not been recently sharpened, and/or has been removed often or for long periods of time since being sharpened. Based on this determination, the monitoring server 130 may overrule its earlier determination that the knife 440 is sharp based on the data from the sensors 404*b*-404*g* and conclude that the knife 440 is dull. The monitoring server 130 may proceed to send instructions to the knife block 410 to lock the knife block 410 due to the dullness of the knife 440, and/or generate and send a notification to the computing device 132 of the authorized user 134 indicating that the knife 440 is dull.

In some implementations, the knife block 410 includes one or more UV lights. For example, one or more UV lights may be secured to the insert 414. These one or more UV lights may disinfect or help to disinfect the knife 410 when it is inserted into the knife block 410 by killing bacteria when they are turned on. The knife block 410 or the system 100 (e.g., the control unit 102 or the monitoring server 130) may turn on the UV lights when it detects that the knife 440 is inserted in the knife block 110. One or more of the UV lights may be aimed at the blade of the knife 440 when the knife 440 is inserted in the knife block 410. One or more of the UV lights may be aimed at the edge of the knife 440 when the knife 440 is inserted in the knife block 410.

In some implementations, the knife block 410 includes one or more knife sharpeners. For example, one or more knife sharpeners may be placed in the opening 416*b* and secured to the insert 414*b*. Each of the one or more knife sharpeners may be a manual sharpener, e.g., sharpen the knife 440 when the knife 440 is inserted into the knife block 410 and/or when the knife 440 is removed from the knife block 410. Each of the one or more knife sharpeners may be an automatic sharpener, e.g., sharpen the knife 440 using a motor after the knife 440 is inserted into the knife block 410. There may be a single knife sharpener in each knife opening of the knife block 410. That is there may be one knife sharpener for each knife that the knife block 410 is meant to receive.

Figure 5A:
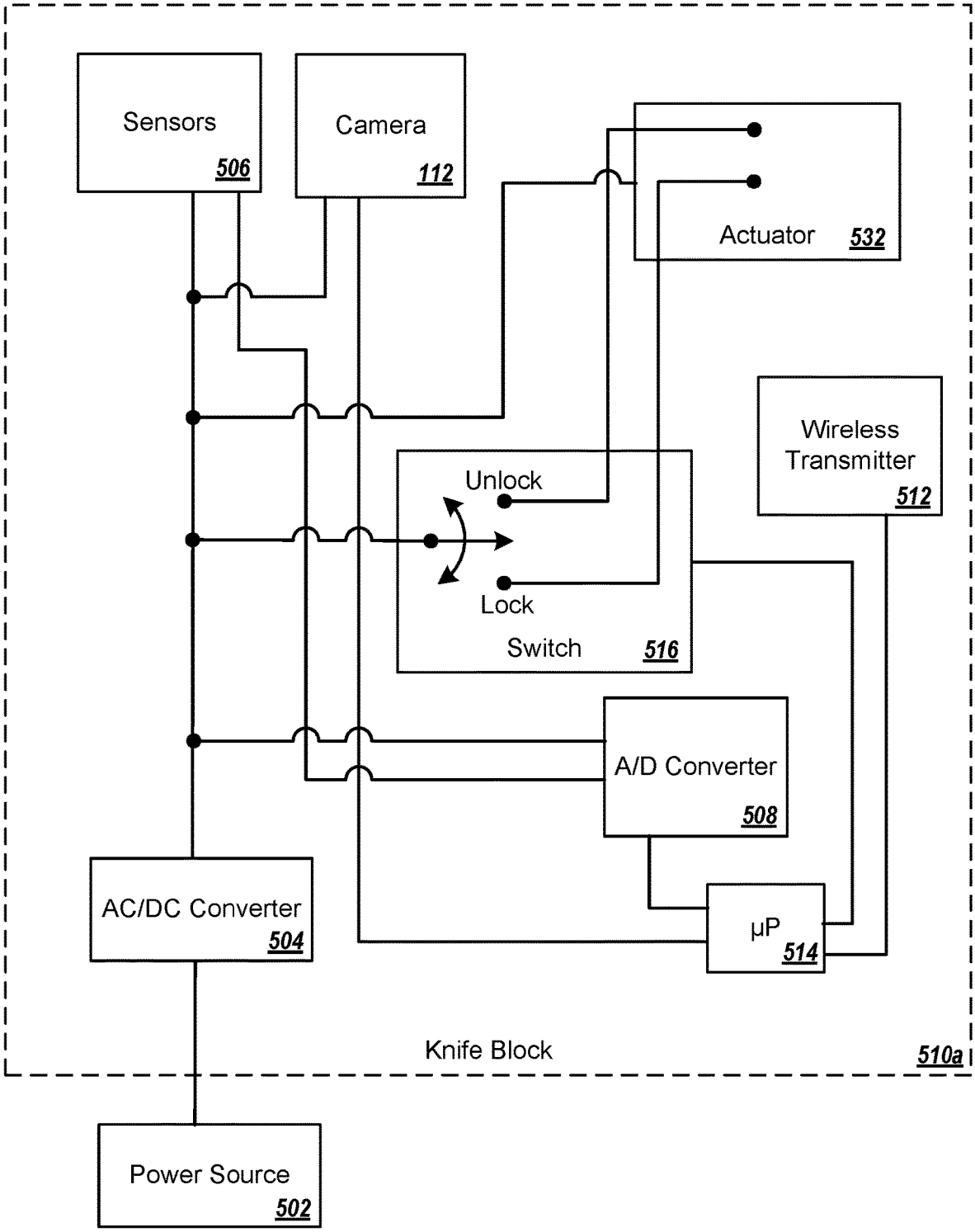
FIG. 5A are 5B are example circuit diagrams of a connected knife block.

FIG. 5A are 5B are example circuit diagrams of the connected knife block 510. In some implementations, the knife block 510 is the knife block 110 shown in FIGS. 1 and 2A-2D. In some implementations, the knife block 510 is the knife block 310 shown in FIGS. 3A-3B. In some implementations, the knife block 510 is the knife block 410 shown in FIGS. 4A-4E.

FIG. 5A is a circuit diagram of the knife block 510*a* which relies on a power source 502 to supply power. The knife block 510*a* includes an AC/DC converter 504, sensors 506, the camera 112, an analog-to-digital (A/D) converter 508, a microprocessor 514, a wireless transmitter 512, a switch 516, and an actuator 532.

The sensors 506 may include sensors corresponding to the buttons of the keypad 124, sensors corresponding to the lock/unlock button 120, the sensors 118*a*-118*c*, the touchscreen display 126, the sensors 118*d*-118*g*, the sensor 404*a*, and/or the sensors 404*b*-404*g*.

The microprocessor 514 may receive outputs from the sensors 506 (e.g., through the A/D converter 508) and output from the camera 112. The microprocessor 514 may perform one or more actions based on the received outputs. For example, the microprocessor 514 may send all or part of these outputs to the control unit 102 and/or the monitoring server 130 using a wireless transmitter 512. The microprocessor 514 may send a signal to the switch 516 based on the received outputs to change the position of the switch 516. For example, the output of the sensors 506 may indicate that the lock/unlock button 120 was pressed by a user. In response, the microprocessor 514 sends a signal to the switch 516 to move the switch 516's position to a locked position, for example, if the switch 516 is currently in an unlocked position. In response to the switch 514's position moving to the lock position, the actuator 532 is triggered and moves the bolt 334 shown in FIGS. 3A-3B is moved to an extended/locked position.

In some implementations, the outputs of one or more sensors of the sensors 506 are sent to the microprocessor 514 through the A/D converter 508, e.g., when the outputs are digital signals. The outputs of these sensors may be sent directly to the microprocessor 514.

The microprocessor 514 may receive input signals through the wireless transmitter 512. For example, the microprocessor 514 may receive instructions from the control unit 102 and/or the monitoring server 130 through the wireless transmitter 512. The microprocessor 514 may perform one or more actions in response to the received input signals. For example, the microprocessor 514 may send a signal to the switch 516 in response to a received input signal, instructing that the switch 514's position be changed. The microprocessor 514 may perform other actions, such as displaying a notification on the touchscreen display 126. The notification as well as instructions to display the notification may have been received through the wireless transmitter 512. The microprocessor 514 may send a signal to the camera 112 to turn on and/or start recording, e.g., based on instructions received through the wireless transmitter 512.

Figure 5B:
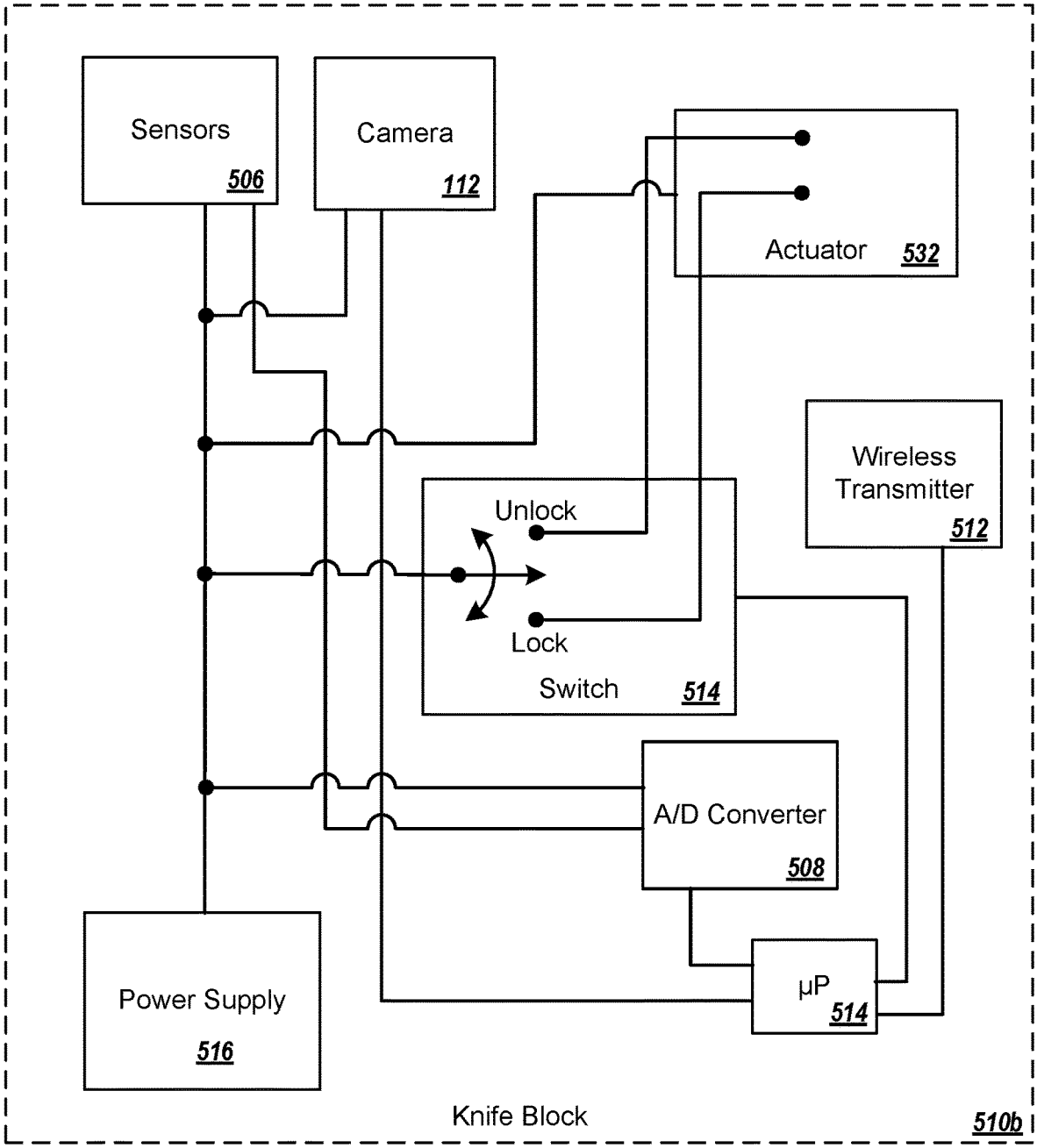

FIG. 5B is a circuit diagram of the knife block 510*b* which includes an onboard power supply 516. The knife block 510*b* also includes the sensors 506, the camera 112, the analog-to-digital (ND) converter 508, the microprocessor 514, the wireless transmitter 512, the switch 516, and the actuator 532.

The power supply 516 may be a battery such as a lithium-ion battery.

FIGS. 6A through 6F are diagrams showing example interfaces for interacting with a security monitoring system.

Figure 6A:
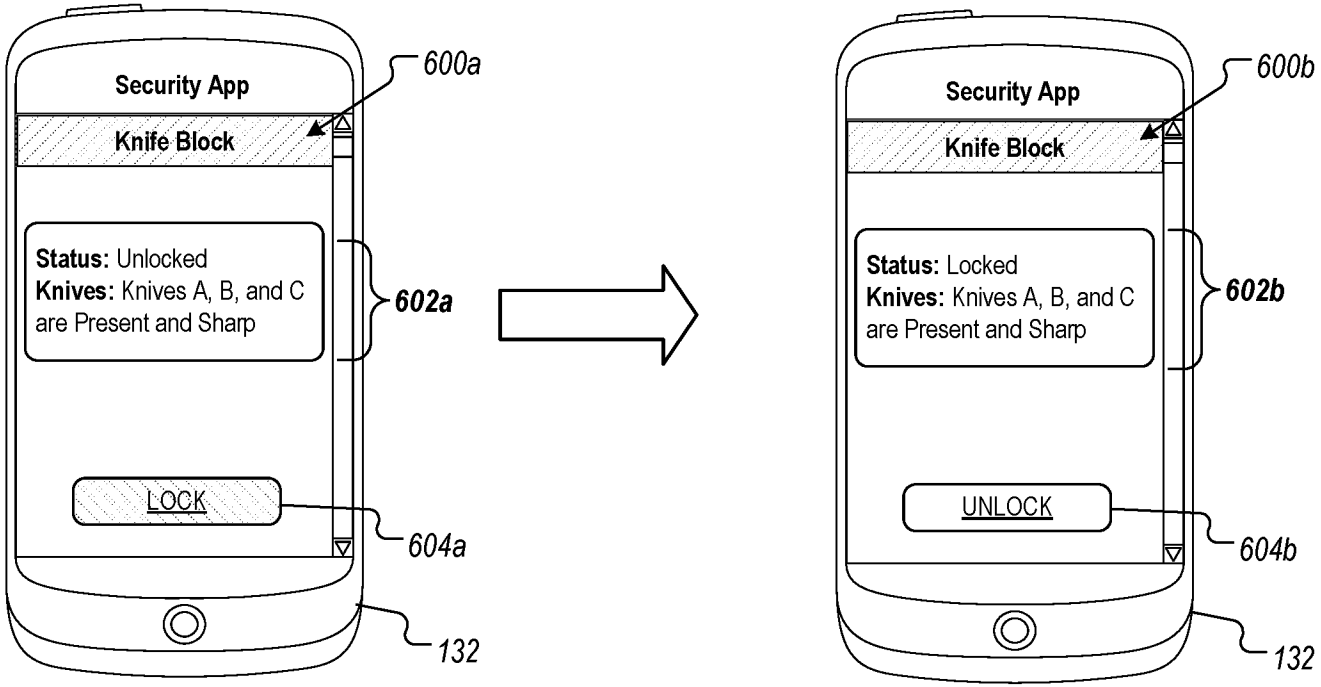
FIGS. 6A through 6F are diagrams showing example interfaces for interacting with a security monitoring system.

FIG. 6A shows interfaces 600*a*-600*b* displayed on the computing device 132 of the authorized user 134. The interfaces 600*a*-600*b* are of a security application, such as a home security application, running on the computing device 132. The interfaces 600*a*-600*b* depict a page for the knife block 110. In the example of FIG. 6A, the authorized user 134 has locked the knife block 110 from the application running on the computing device 132.

Interface 600*a* provides information 602*a* corresponding to the knife block 110. The information 602*a* includes a current status or state of the knife block 110. The information 602*a* includes information related to the knives of the knife block, such as what knives are present or missing, and what knives are sharp or dull. As shown, the information 602*a* provides that the knife block 110 is currently unlocked, and that the knives A, B, and C are all present in the knife block 110 and are all sharp.

The interface 600*a* also includes an interface element 604*a*. The interface element 604*a* allows the authorized user 134 to change the status or state of the knife block 110, e.g., to lock the knife block 110.

Here, the authorized user 134 has selected the interface element 604*a*, resulting in the display of the computing device 132 transitioning from the interface 600*a* to the interface 600*b*, and in the knife block 110 being locked. As shown, the updated information 602*b* indicates that the knife block 110 is now locked.

The interface 600*b* also includes an interface element 604*b*. The interface element 604*b* allows the authorized user 134 to change the status or state of the knife block 110, e.g., to unlock the knife block 110.

Figure 6B:
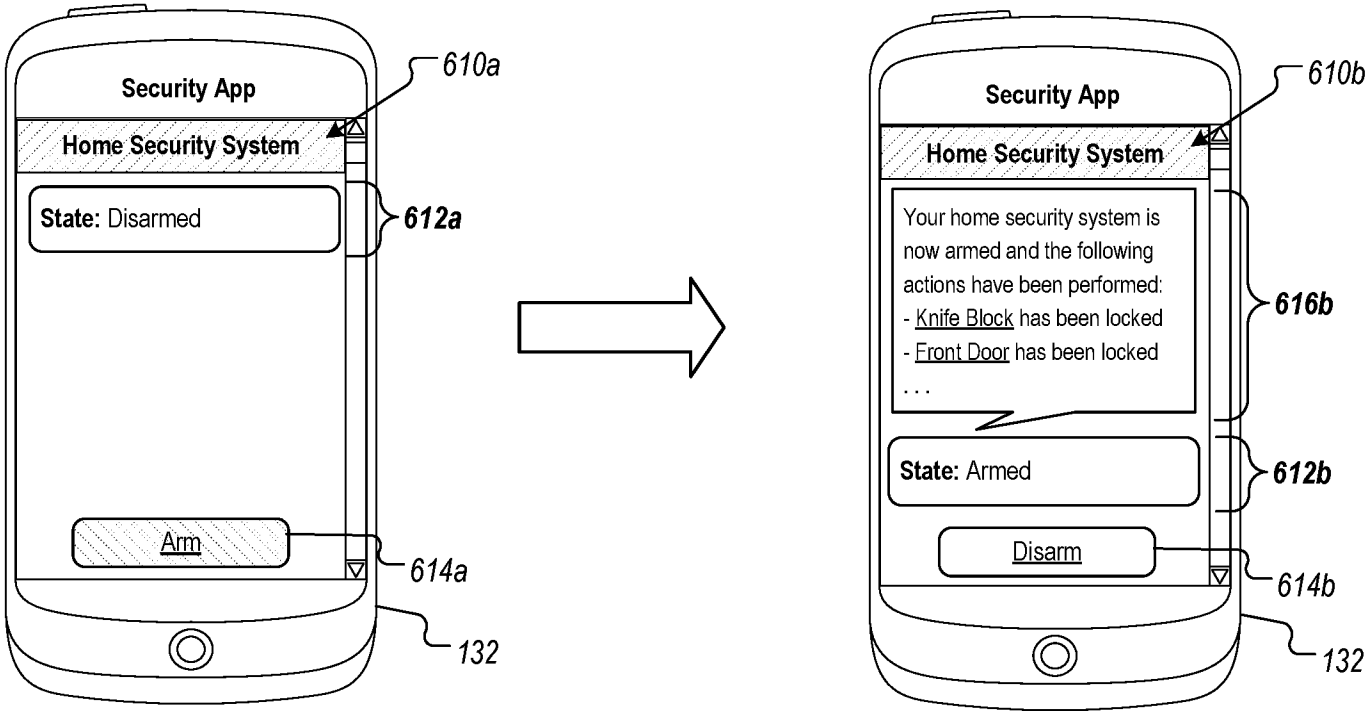

FIG. 6B shows interfaces 610*a*-610*b* displayed on the computing device 132 of the authorized user 134. The interfaces 610*a*-610*b* are of a security application, such as a home security application, running on the computing device 132. The interfaces 610*a*-610*b* depict a page for a home security system (e.g., the system 100). In the example of FIG. 6B, the authorized user 134 has armed the home security system through the application running on the computing device 132.

The interface 610*a* provides information 612*a* indicating a current state of the home security system. As shown, the information 612*a* indicates that the home security system is currently disarmed.

The interface 610*a* also includes an interface element 614*a*. The interface element 614*a* allows the authorized user 134 to change the state of the home security system, e.g., to arm the home security system.

Here, the authorized user 134 has selected the interface element 614*a*, resulting in the display of the computing device 132 transitioning from the interface 610*a* to the interface 610*b*, and in the home security system being armed. As a result of the home security system being armed, the knife block 110 and the front door 154 have automatically been locked by the home security system.

The interface 610*b* includes a notification 616*b* that indicates the home security system has been armed and the resulting actions performed. For example, the notification 616*b* indicates that the front door 154 and the knife block 110 have been locked.

The interface 610*b* also provides information 612*b* indicating a current state of the home security system. As shown, the information 612*b* indicates that the home security system is currently armed.

The interface 610*b* also includes an interface element 614*b*. The interface element 614*b* allows the authorized user 134 to change the state of the home security system, e.g., to disarm the home security system.

Figure 6C:
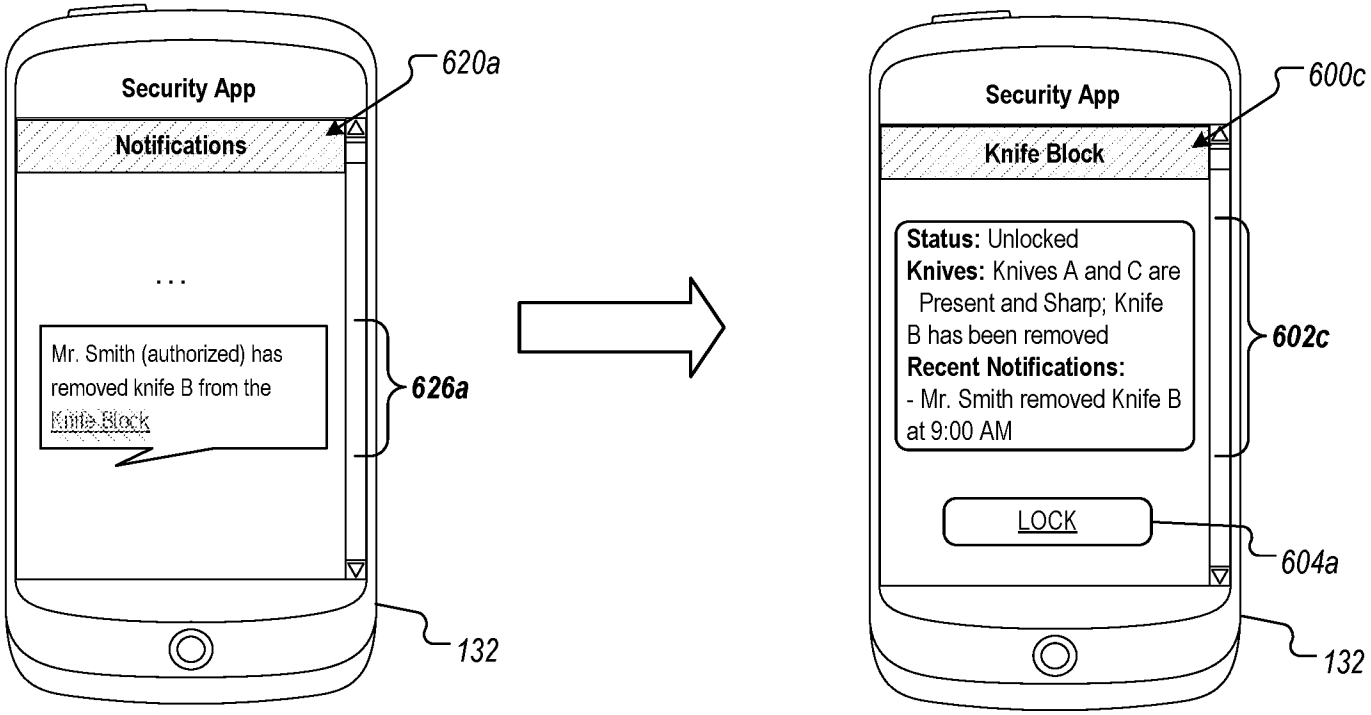

FIG. 6C shows interfaces 620*a* and 600*c* displayed on the computing device 132 of the authorized user 134. The interfaces 620*a* and 600*c* are of a security application, such as a home security application, running on the computing device 132. In the example of FIG. 6C, an authorized user has removed a knife from the knife block 110.

The interface 620*a* depicts a notification page that displays, for example, recent notifications related to the authorized user 134's security system 100. As an example, the notifications displayed in the interface 620*a* may relate to persons entering the property 150, persons interacting with the knife block 110, a window of the property 150 being opened, a security alarm being triggered, or the like. As shown, the interface 620*a* includes a notification 626*a*. As shown, the notification 626*a* provides that an authorized user ("Mr. Smith") has removed knife B from the knife block 110.

The term "Knife Block" has been underlined in the notification 626*a*, indicating a link to the page for the knife block 110. Here, the authorized user 134 has selected the link to the page for the knife block 110, resulting in the authorized user 134 being directed to the interface 600*c*.

The interface 600*c* depicts a page for the knife block 110 and displays information 602*c* corresponding to the knife block 110. The information 602*c* includes a current status or state of the knife block 110. The information 602*c* also includes information related to the knives of the knife block, such as what knives are present or missing, and what knives are sharp or dull. The information 602*c* also includes recent security notification related to the knife block 110. As shown, the information 602*c* provides that the knife block 110 is currently unlocked, and that the knives A and C are present in the knife block 110 and are sharp. The information 602*c* also provides that knife B was removed by Mr. Smith at 9:00 am and has yet to be replaced. The system 100 (e.g., through the control unit 102 and/or the monitoring server 130) may have identified Mr. Smith by obtaining image data from the camera 112 of the knife block 110 and/or image data collected by the cameras 158*a*-158*b*, and comparing the collected image data with one or more stored images known to depict authorized and/or unauthorized users—or with data retrieved from one or more stored images known to depict authorized and/or unauthorized users. The system 100 and/or the knife block 110 may have confirmed that knives A and C are present and that knife B is missing using, for example, sensor data from the sensors 118*a*-118*c*.

The interface 600*c* also includes the interface element 604*a*. The interface element 604*a* allows the authorized user 134 to change the status or state of the knife block 110, e.g., to lock the knife block 110.

Figure 6D:
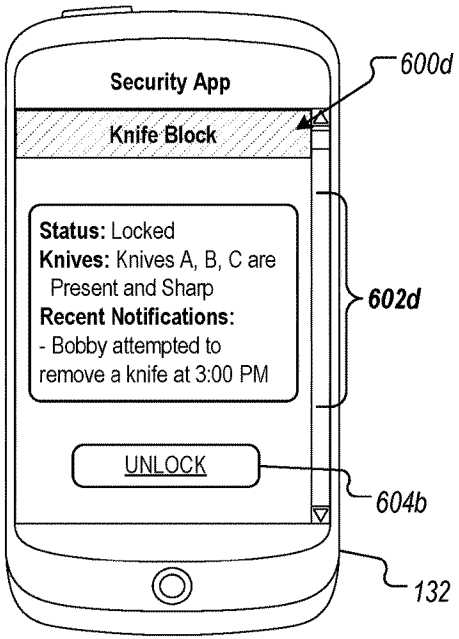
Figure 6D:
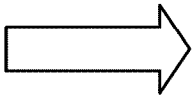
Figure 6D:
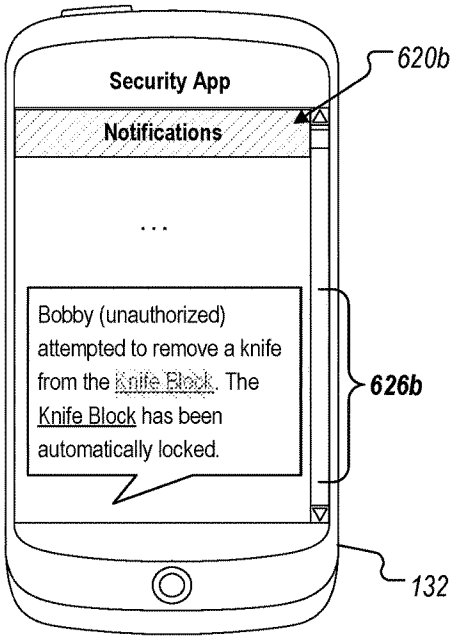

FIG. 6D shows interfaces 620*b* and 600*d* displayed on the computing device 132 of the authorized user 134. The interfaces 620*b* and 600*d* are of a security application, such as a home security application, running on the computing device 132. In the example of FIG. 6D, an unauthorized user has attempted to remove a knife from the knife block 110.

The interface 620*b* depicts a notification page that displays, for example, recent notifications related to the authorized user 134's security system 100. As an example, the notifications displayed in the interface 620*b* may relate to persons entering the property 150, persons interacting with the knife block 110, a window of the property 150 being opened, a security alarm being triggered, or the like. As shown, the interface 620*b* includes a notification 626*b*. As shown, the notification 626*b* provides that an unauthorized user ("Bobby") has attempted to remove a knife from the knife block 110, and the knife block 110 has automatically been locked as a result. As an example, the system 100 (e.g., through the control unit 102 and/or the monitoring server 130) may have identified Bobby using image data collected by the camera 112 of the knife block 110 and/or image data collected by the cameras 158*a*-158*b* as Bobby was approaching the knife block 110, in front of the knife block 110, and/or interacting with the knife block 110. The system 100 may have proceeded to compare the collected image data with one or more stored images known to depict authorized and/or unauthorized users—or with data retrieved from one or more stored images known to depict authorized and/or unauthorized users. In response to identifying an unauthorized user, the system 100 may have sent instructions to the knife block 110 to lock the knife block 110 if it was in an unlocked state. The system 100 may have determined that Bobby attempted to remove a knife based on, for example, sensor data from an accelerometer in the knife block 110, and/or sensor data from one of the sensors 118*a*-118*c* indicating that one of the knives was pulled away from the knife block 110 before being stopped by the bolt 334.

The term "Knife Block" has been underlined in the notification 626*b*, indicating a link to the page for the knife block 110. Here, the authorized user 134 has selected the link to the page for the knife block 110, resulting in the authorized user 134 being directed to the interface 600*d*.

The interface 600*d* depicts a page for the knife block 110 and displays information 602*d* corresponding to the knife block 110. The information 602*d* includes a current status or state of the knife block 110. The information 602*d* also includes information related to the knives of the knife block, such as what knives are present or missing, and what knives are sharp or dull. The information 602*d* also includes recent security notifications related to the knife block 110. As shown, the information 602*d* provides that the knife block 110 is currently locked, and that the knives A, B, and C are all present in the knife block 110 and are all sharp. The information 602*d* also provides a recent security notification that Bobby attempted to remove a knife from the knife block 110 at 3:00 pm.

The interface 600*d* also includes the interface element 604*b*. The interface element 604*b* allows the authorized user 134 to change the status or state of the knife block 110, e.g., to unlock the knife block 110.

Figure 6E:
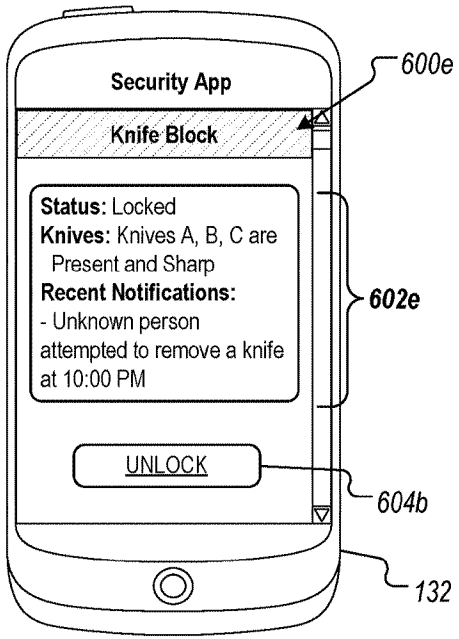
Figure 6E:
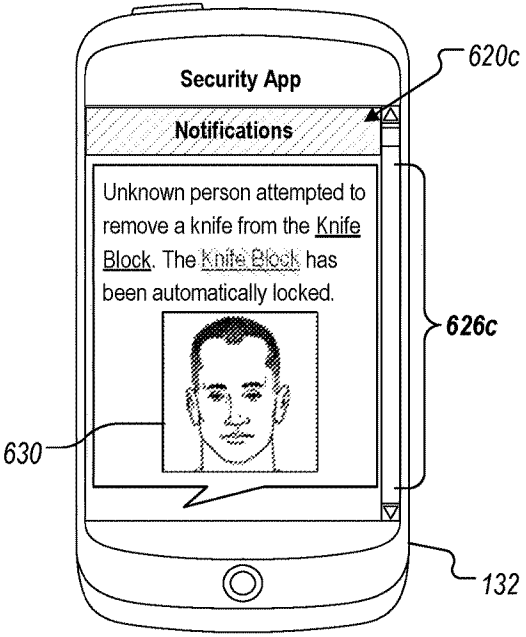

FIG. 6E shows interfaces 620*c* and 600*e* displayed on the computing device 132 of the authorized user 134. The interfaces 620*c* and 600*e* are of a security application, such as a home security application, running on the computing device 132. In the example of FIG. 6E, an unknown, and therefore unauthorized, person has attempted to remove a knife from the knife block 110.

The interface 620*c* depicts a notification page that displays, for example, recent notifications related to the authorized user 134's security system 100. As an example, the notifications displayed in the interface 620*c* may relate to persons entering the property 150, persons interacting with the knife block 110, a window of the property 150 being opened, a security alarm being triggered, or the like. As shown, the interface 620*c* includes a notification 626*c*. As shown, the notification 626*c* provides that an unknown person has attempted to remove a knife from the knife block 110, and the knife block 110 has automatically been locked as a result. The notification 626*c* also includes an image 630 of the unknown person that attempted to remove a knife that was taken from the camera 112 of the knife block 110. As an example, the system 100 (e.g., through the control unit 102 and/or the monitoring server 130) may have attempted to identify the unknown person using image data collected by the camera 112 of the knife block 110 and/or image data collected by the cameras 158*a*-158*b* as the person was approaching the knife block 110, in front of the knife block 110, and/or interacting with the knife block 110. The system 100 may have proceeded to compare the collected image data with one or more stored images known to depict authorized and/or unauthorized users—or with data retrieved from one or more stored images known to depict authorized and/or unauthorized users. In response to failing to identify the unknown person, the system 100 may have sent instructions to the knife block 110 to lock the knife block 110 if it was in an unlocked state. The system 100 may have determined that the unknown person attempted to remove a knife based on, for example, sensor data from an accelerometer in the knife block 110, and/or sensor data from one of the sensors 118*a*-118*c* indicating that one of the knives was pulled away from the knife block 110 before being stopped by the bolt 334.

The term "Knife Block" has been underlined in the notification 626*c*, indicating a link to the page for the knife block 110. Here, the authorized user 134 has selected the link to the page for the knife block 110, resulting in the authorized user 134 being directed to the interface 600*e*.

The interface 600*e* depicts a page for the knife block 110 and displays information 602*e* corresponding to the knife block 110. The information 602*e* includes a current status or state of the knife block 110. The information 602*e* also includes information related to the knives of the knife block, such as what knives are present or missing, and what knives are sharp or dull. The information 602*e* also includes recent security notifications related to the knife block 110. As shown, the information 602*e* provides that the knife block 110 is currently locked, and that the knives A, B, and C are all present in the knife block 110 and are all sharp. The information 602*e* also provides a recent security notification that an unknown person attempted to remove a knife from the knife block 110 at 10:00 pm.

The interface 600*e* also includes the interface element 604*b*. The interface element 604*b* allows the authorized user 134 to change the status or state of the knife block 110, e.g., to unlock the knife block 110.

Figure 6F:
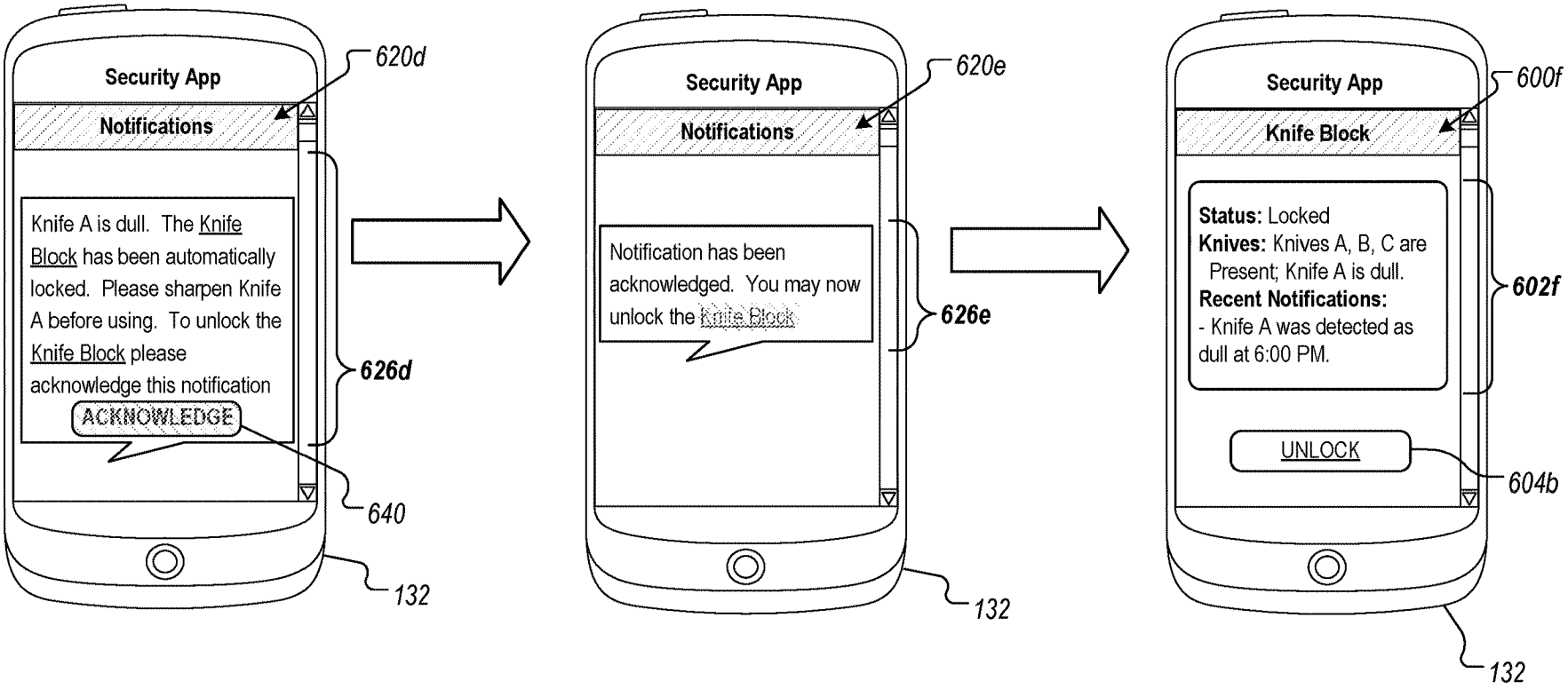

FIG. 6F shows interfaces 620*d*-620*e* and 600*f* displayed on the computing device 132 of the authorized user 134. The interfaces 620*d*-620*e* and 600*f* are of a security application, such as a home security application, running on the computing device 132. In the example of FIG. 6F, the knife block 110 or the system 100 (e.g., through the control unit 102 and/or the monitoring server 130) based on sensor data received from the knife block 110 has detected that a knife is dull.

The interface 620*d* depicts a notification page that displays, for example, recent notifications related to the authorized user 134's security system 100. As shown, the interface 620*d* includes a notification 626*d*. As shown, the notification 626*d* provides that the system 100 (e.g., through the control unit 102 and/or the monitoring server 130) has determined that knife A is dull. The notification 626*d* also provides a warning to sharpen knife A before using. The notification 626*d* also includes an interface element 640. The interface element 640 is an interactive element that provides the authorized user 134 with a means to acknowledge the notification 626*d*, e.g., the warning within the notification 626*d*. For example, the authorized user 134 must select the interface element 640 in order to acknowledge the warning and to unlock the knife block 110. The system 100 may have determined that knife A is dull using the techniques described above with respect to FIGS. 4A-4E.

The term "Knife Block" has been underlined in the notification 626*d*, indicating a link to the page for the knife block 110. If the authorized user 134 were to select this link and be taken to a page for the knife block 110, the option to unlock the knife block 110 may be missing from the page for the knife block 110 or may be grayed out to prevent the authorized user 134 from unlocking the knife block 110 until they have first acknowledged the notification 626*d*.

Here the authorized user 134 has selected the interface element 640, resulting in the authorized user 134 being shown the interface 620*e*.

The interface 620*e* depicts an updated notification page that displays a new notification 626*e*. The notification 626*e* confirms to the authorized user 134 that they have acknowledged the notification 626*d* and are now permitted to unlock the knife block 110. The term "Knife Block" has been underlined in the notification 626*e*, indicating a link to the page for the knife block 110. Here, the authorized user 134 has selected the link to the page for the knife block 110, resulting in the authorized user 134 being directed to the interface 600*f*.

The interface 600*f* depicts a page for the knife block 110 and displays information 602*f* corresponding to the knife block 110. The information 602*f* includes a current status or state of the knife block 110. The information 602*f* also includes information related to the knives of the knife block, such as what knives are present or missing, and what knives are sharp or dull. The information 602*f* also includes recent security notifications related to the knife block 110. As shown, the information 602*f* provides that the knife block 110 is currently locked, and that the knives A, B, and C are all present in the knife block 110 but that knife A is dull. The information 602*f* also provides a recent security notification that knife A was detected as dull at 6:00 pm.

The interface 600*f* also includes the interface element 604*b*. The interface element 604*b* allows the authorized user 134 to change the status or state of the knife block 110, e.g., to unlock the knife block 110.

In some implementations, instead of locking the knife block 110 as a result of determining that a person removing or attempting to remove a knife from the knife block 110 is either unknown or unauthorized, the system 100 (e.g., through the control unit 102 and/or the monitoring server 130) automatically locks the knife block 110, by sending instructions to the knife block 110, when it determines that a person is in the vicinity of the knife block 110 (e.g., that a person is in the kitchen 152) and/or is approaching the knife block 110. The system 100 will then proceed to unlock the knife block 110 once the person has been identified as an authorized user, or once the person has entered a security code through the keypad 124 or through the touchscreen display 126.

In some implementations, the knife block 110 includes one or more biometric sensors. The system 100 (e.g., through the control unit 102 and/or the monitoring server 130) may uses output from the one or more biometric sensors to identify a person attempting to retrieve the knife and to determine if they are an authorized user. The biometric sensors may include a fingerprint reader, an iris scanner, or the like.

In some implementations, the authorized user 134 can set a schedule, e.g., through the computing device 132, for the state of the knife block 110. For example, the authorized user 134 can set a schedule to have the knife block 110 locked during the hours that they are generally at work on the weekdays.

In some implementations, there are multiple authorized users. For example, the owners of a home or property may each be an authorized user, employees such as a chef or a cook may be authorized users, persons, e.g., children, that have been authorized by an authorized user, e.g., a parent, may be authorized users, etc.

Figure 7:
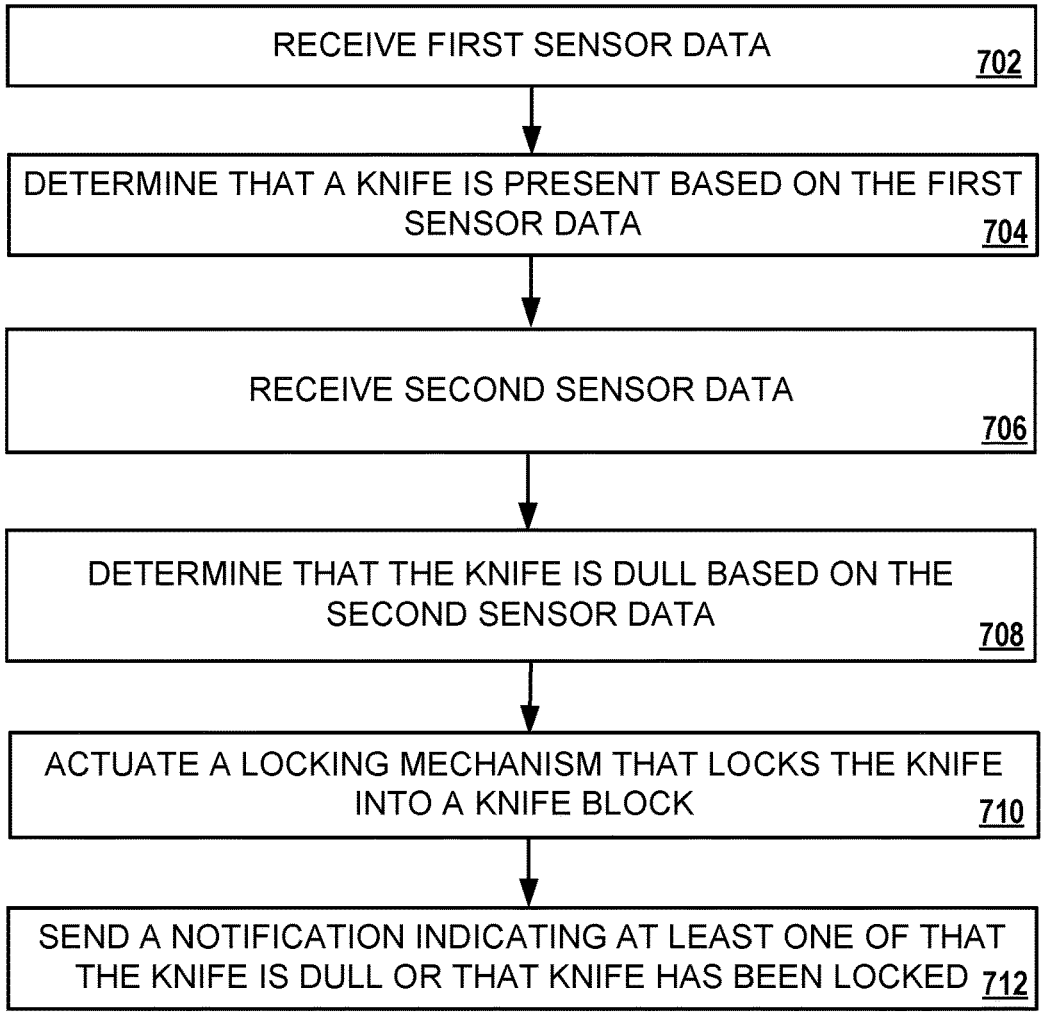
FIG. 7 is a flowchart of an example process for changing the state of a connected knife block.

FIG. 7 is a flowchart of an example process 700 for changing the state of a connected knife block. The process 700 can be performed, at least in part, using the system 100 described in FIG. 1, the knife block 110 described in FIGS. 1 and 2A-2D, the knife block 310 described in FIGS. 3A-3B, the knife block 410 described in FIGS. 4A-4E, the knife block 510 described in FIGS. 5A-5B, or the home monitoring system 900 described in FIG. 9.

The process 700 includes receiving first sensor data (702). For example, with respect to FIGS. 2A-2D, the sensor data may be the data output by one or more, or all, of the sensors 118*a*-118*c*. With respect to FIGS. 4A-4E, the sensor data may include the data output by the sensor 418. The sensor data may be received at the microprocessor 514 of the knife block 510 shown in FIG. 5A-5B. The sensor data may be received at the control unit 102 shown in FIG. 1, e.g., from the knife block 110. The sensor data may be received at the monitoring server 130 shown in FIG. 1, e.g., from the knife block 110 or the control unit 102.

The process 700 includes determining that the knife is present based on the first sensor data (704). For example, the outputs of one of the sensors 118*a*-118*c* may have a value that falls within a first range of values. This first range of values may correlate with an indication that the corresponding knife is in the knife block 110. Accordingly, the system 100 may determine that the sensor data indicates that the knife and, therefore, that the knife is present in the knife block 110.

The process 700 includes receiving second sensor data (706). For example, with respect to FIGS. 4A-4E, the second sensor data may be the data output by one or more, or all, of the sensors 404*a*-404*g*. The second sensor data may also include the data output by other sensors located in different openings of the knife block 410.

In some implementations, the process 700 does not include receiving second sensor data.

The process 700 includes determining that the knife is dull based on the second sensor data (708). For example, with respect to FIGS. 4A-4E, the outputs of one or more of the sensors 404*a*-404*g* may have a value(s) that fall within one or more particular ranges of values. These one or more ranges of values may correlate with an indication that the corresponding knife is dull, e.g., an indication that the knife has not passed or cut through the piece of material 402*a* and/or the piece of material 402*b*. As another example, there may be no output from the one or more sensors (e.g., where the one or more sensors are switches), indicating that the corresponding knife is dull as it has not passed or cut through the piece of material 402*a* and/or the piece of material 402*b*.

In implementations where the process 700 does not include receiving second sensor data, the process 700 includes determining that the knife is dull based on the first sensor data or based on other data. For example, as described above, the system 100 may determine that a knife is dull based on the output from the sensor 418 having a value that falls within a range of values that correlate with the corresponding knife not being fully inserted into the corresponding opening, e.g., due to the knife failing to pass or cut through the piece of material 402*a* and/or the piece of material 402*b*. As another example, as described above, the system 100 may determine that a knife is dull based on one or more of the amount of time the knife has been removed from the knife block 110 for, the amount of time that has passed since the knife was last viewed to be sharpened, the amount of time the knife has been removed from the knife block 110 since the knife was last viewed to be sharpened, the number of times that the knife has been removed from the knife block 110, the number of times that the knife has been removed from the knife block 110 since the knife was last viewed to be sharpened, etc.

The process 700 includes actuating a locking mechanism that locks the knife into a knife block (710). For example, with respect to FIGS. 3A-3B, the locking mechanism may include the actuator 332 and the bolt 334. Actuating the locking mechanism may include using the actuator 332 to slide the bolt 334 through one or more knives inserted into the knife block 310. Actuating the locking mechanism may include using the actuator 332 to cause the bolt 334 to telescope from a compact/unlocked state shown in FIG. 3A to an extended/locked state shown in FIG. 3B.

The process 700 includes sending a notification indicating at least one of that the knife is dull or that knife has been locked (710). With respect to FIG. 1, the notification may be sent by the knife block 110 to the computing device 132 of the authorized user 134. The notification may be sent by the control unit 102 to the computing device 132 of the authorized user 134. The notification may be sent by the monitoring server 130 to the computing device 132 of the authorized user 134. With respect to FIGS. 6A-6F, the notification may be presented on a security application running on the computing device 132, e.g., on a notification page of the security application.

Figure 8:
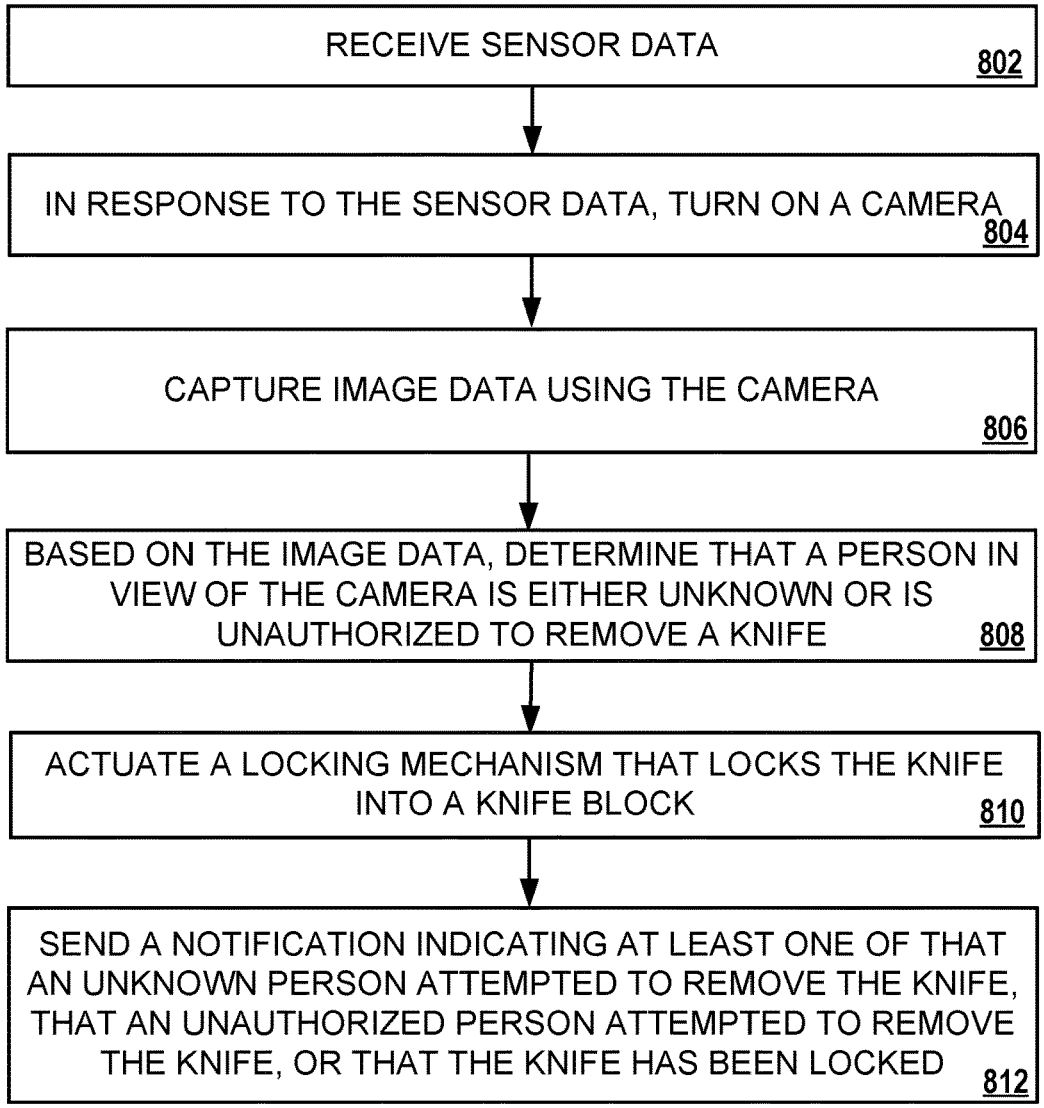
FIG. 8 is a flowchart of an example process 800 for changing the state of a connected knife block.

FIG. 8 is a flowchart of an example process 800 for changing the state of a connected knife block. The process 800 can be performed, at least in part, using the system 100 described in FIG. 1, the knife block 110 described in FIGS. 1 and 2A-2D, the knife block 310 described in FIGS. 3A-3B, the knife block 410 described in FIGS. 4A-4E, the knife block 510 described in FIGS. 5A-5B, or the home monitoring system 900 described in FIG. 9.

The process 800 includes receiving sensor data (802). For example, with respect to FIGS. 2A-2D, the sensor data may include the output of one or more of the sensors 118*a*-118*c*, the keypad 124, the lock/unlock button 120, or the touchscreen display 126. For example, with respect to FIGS. 4A-4E, the sensor data may include the output of one or more of the sensors 418 and 404*a*-404*g*. For example, with respect to FIGS. 5A-5B, the sensor data may include the output of the sensors 506. The sensors 506 may include, for example, an accelerometer.

The process 800 includes, in response to the sensor data, turning on a camera (804). For example, the system 100 (e.g., through the control unit 102 or the monitoring server 130) or the knife block 110 may turn on the camera 112 in response to determining that: a person has attempted to remove a knife based on the output of an accelerometer in the knife block 110 and/or based on the output of one of the sensors 118*a*-118*c*; a person has removed a knife based on the output of one of the sensors 118*a*-118*c*; a person has successfully entered a code through the keypad 124 or the touchscreen display 126 to unlock the knife block 110; a person has entered an incorrect code through the keypad 124 or the touchscreen display 126; or a person has pressed the lock/unlock button 120 when the knife block 110 was locked.

The process 800 includes capturing image data using the camera (806). For example, with respect to FIGS. 5A-5B, the knife block 510 may capture image data using the camera 112. The knife block 510 may also transmit the capture image data to the control unit 102 and/or to the monitoring server 130. The control unit 102 may transmit image data that it receives from the knife block 510 to the monitoring server 130. In some implementations, the captured image data may be transmitted to the computing device 132 of the authorized user, e.g., by the knife block 510, the control unit 102, or the monitoring server 130.

The process 800 includes, based on the image data, determining that a person in view of the camera is either unknown or is unauthorized to remove a knife (808). For example, with respect to FIG. 1, the knife block 110, the control unit 102, or the monitoring server 130 may compare the image data with stored images of authorized and/or unauthorized users, or may compare the image data with data retrieved from images of authorized and/or unauthorized users. If the knife block 110, the control unit 102, or the monitoring server 130 determines that a person appearing in the image data matches an unauthorized user, then the knife block 110, the control unit 102, or the monitoring server 130 determines that an unauthorized user is in view of the camera 112. If the knife block 110, the control unit 102, or the monitoring server 130 determines that a person appearing in the image data does not match any authorized or unauthorized users, then the knife block 110, the control unit 102, or the monitoring server 130 determines that an unknown person is in view of the camera 112.

The process 800 includes actuating a locking mechanism that locks the knife into a knife block (810). For example, with respect to FIGS. 3A-3B, the locking mechanism may include the actuator 332 and the bolt 334. Actuating the locking mechanism may include using the actuator 332 to slide the bolt 334 through one or more knives inserted into the knife block 310. Actuating the locking mechanism may include using the actuator 332 to cause the bolt 334 to telescope from a compact/unlocked state shown in FIG. 3A to an extended/locked state shown in FIG. 3B.

The process 800 includes sending a notification indicating at least one of that an unknown person attempted to remove the knife, that an unauthorized person attempted to remove the knife, or that the knife has been locked (812). With respect to FIG. 1, the notification may be sent by the knife block 110 to the computing device 132 of the authorized user 134. The notification may be sent by the control unit 102 to the computing device 132 of the authorized user 134. The notification may be sent by the monitoring server 130 to the computing device 132 of the authorized user 134. With respect to FIGS. 6A-6F, the notification may be presented on a security application running on the computing device 132, e.g., on a notification page of the security application. With respect to FIG. 6D, if the person in view of the camera 112 is determined to be an unauthorized user, the knife block 110, the control unit 102, or the monitoring server 130 may send a notification to the computing device 132 of the authorized user 134 that is similar to the notification 626*b*. With respect to FIG. 6E, if the person in view of the camera 112 is determined to be an unknown person, the knife block 110, the control unit 102, or the monitoring server 130 may send a notification to the computing device 132 of the authorized user 134 that is similar to the notification 626*c*.

Figure 9:
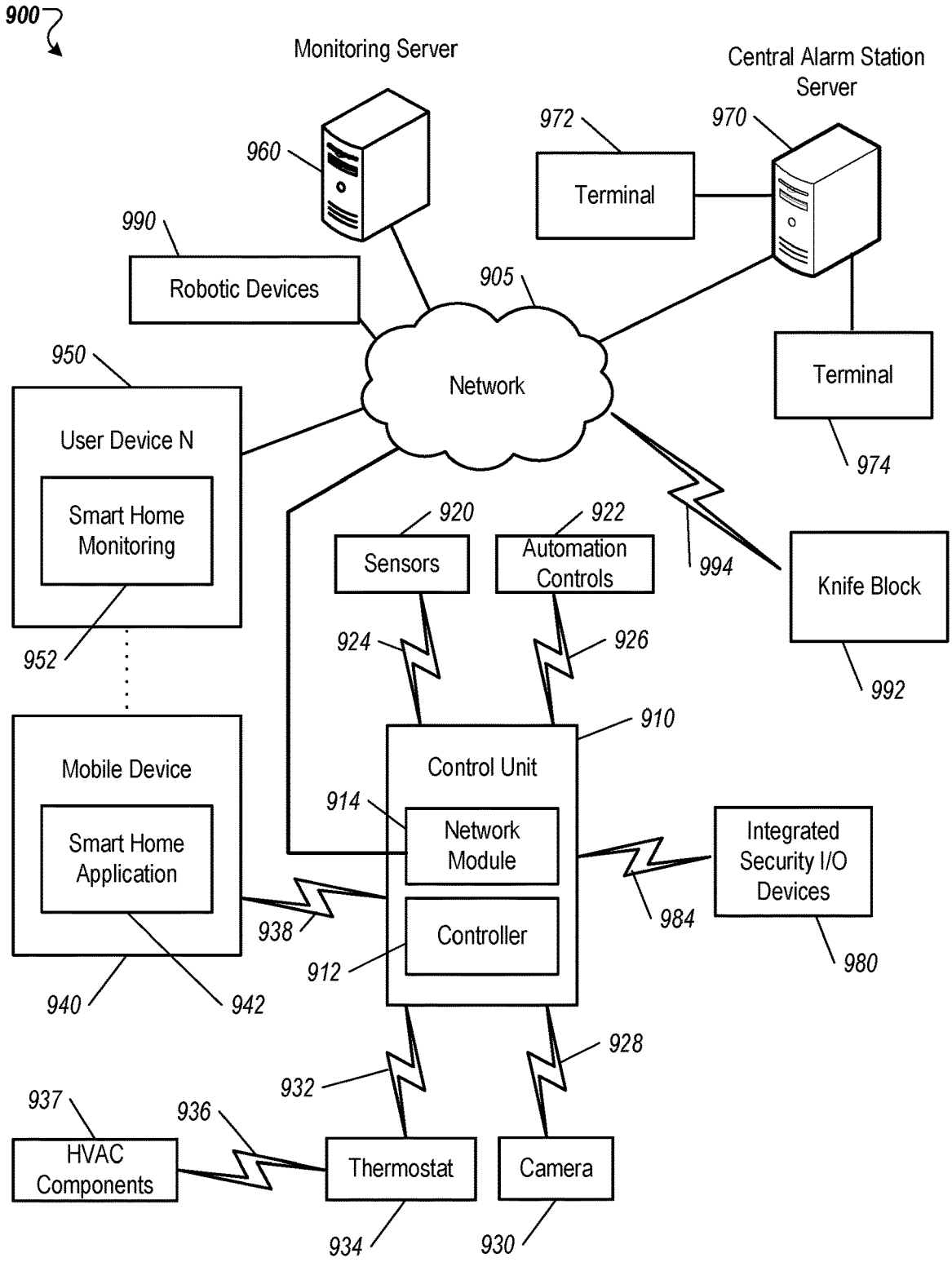
FIG. 9 is a diagram illustrating an example of a home monitoring system with a connected knife block.

FIG. 9 is a diagram illustrating an example of a home monitoring system 900 with a connected knife block 992. The knife block 992 may be the knife block 110 shown in FIGS. 1 and 2A-2D, the knife block 310 shown in FIGS. 3A-3B, the knife block 410 shown in FIGS. 4A-4E, the knife block 510 shown in FIGS. 5A-5B. The home monitoring system 900 may be the system 100 shown in FIG. 1. The monitoring system 900 includes a network 905, a control unit 910, one or more user devices 940 and 950, a monitoring server 960, and a central alarm station server 970. In some examples, the network 905 facilitates communications between the control unit 910, the one or more user devices 940 and 950, the monitoring server 960, and the central alarm station server 970.

The network 905 is configured to enable exchange of electronic communications between devices connected to the network 905. For example, the network 905 may be configured to enable exchange of electronic communications between the control unit 910, the one or more user devices 940 and 950, the monitoring server 960, and the central alarm station server 970. The network 905 may include, for example, one or more of the Internet, Wide Area Networks (WANs), Local Area Networks (LANs), analog or digital wired and wireless telephone networks (e.g., a public switched telephone network (PSTN), Integrated Services Digital Network (ISDN), a cellular network, and Digital Subscriber Line (DSL)), radio, television, cable, satellite, or any other delivery or tunneling mechanism for carrying data. Network 905 may include multiple networks or subnetworks, each of which may include, for example, a wired or wireless data pathway. The network 905 may include a circuit-switched network, a packet-switched data network, or any other network able to carry electronic communications (e.g., data or voice communications). For example, the network 905 may include networks based on the Internet protocol (IP), asynchronous transfer mode (ATM), the PSTN, packet-switched networks based on IP, X.25, or Frame Relay, or other comparable technologies and may support voice using, for example, VoIP, or other comparable protocols used for voice communications. The network 905 may include one or more networks that include wireless data channels and wireless voice channels. The network 905 may be a wireless network, a broadband network, or a combination of networks including a wireless network and a broadband network.

The control unit 910 includes a controller 912 and a network module 914. The controller 912 is configured to control a control unit monitoring system (e.g., a control unit system) that includes the control unit 910. In some examples, the controller 912 may include a processor or other control circuitry configured to execute instructions of a program that controls operation of a control unit system. In these examples, the controller 912 may be configured to receive input from sensors, flow meters, or other devices included in the control unit system and control operations of devices included in the household (e.g., speakers, lights, doors, etc.). For example, the controller 912 may be configured to control operation of the network module 914 included in the control unit 910.

The network module 914 is a communication device configured to exchange communications over the network 905. The network module 914 may be a wireless communication module configured to exchange wireless communications over the network 905. For example, the network module 914 may be a wireless communication device configured to exchange communications over a wireless data channel and a wireless voice channel. In this example, the network module 914 may transmit alarm data over a wireless data channel and establish a two-way voice communication session over a wireless voice channel. The wireless communication device may include one or more of a LTE module, a GSM module, a radio modem, cellular transmission module, or any type of module configured to exchange communications in one of the following formats: LTE, GSM or GPRS, CDMA, EDGE or EGPRS, EV-DO or EVDO, UMTS, or IP.

The network module 914 also may be a wired communication module configured to exchange communications over the network 905 using a wired connection. For instance, the network module 914 may be a modem, a network interface card, or another type of network interface device. The network module 914 may be an Ethernet network card configured to enable the control unit 910 to communicate over a local area network and/or the Internet. The network module 914 also may be a voice band modem configured to enable the alarm panel to communicate over the telephone lines of Plain Old Telephone Systems (POTS).

The control unit system that includes the control unit 910 includes one or more sensors. For example, the monitoring system may include multiple sensors 920. The sensors 920 may include a lock sensor, a contact sensor, a motion sensor, or any other type of sensor included in a control unit system. The sensors 920 also may include an environmental sensor, such as a temperature sensor, a water sensor, a rain sensor, a wind sensor, a light sensor, a smoke detector, a carbon monoxide detector, an air quality sensor, etc. The sensors 920 further may include a health monitoring sensor, such as a prescription bottle sensor that monitors taking of prescriptions, a blood pressure sensor, a blood sugar sensor, a bed mat configured to sense presence of liquid (e.g., bodily fluids) on the bed mat, etc. In some examples, the health-monitoring sensor can be a wearable sensor that attaches to a user in the home. The health-monitoring sensor can collect various health data, including pulse, heart rate, respiration rate, sugar or glucose level, bodily temperature, or motion data.

The sensors 920 can also include a radio-frequency identification (RFID) sensor that identifies a particular article that includes a pre-assigned RFID tag.

The control unit 910 communicates with the home automation controls 922 and a camera 930 to perform monitoring. The home automation controls 922 are connected to one or more devices that enable automation of actions in the home. For instance, the home automation controls 922 may be connected to one or more lighting systems and may be configured to control operation of the one or more lighting systems. In addition, the home automation controls 922 may be connected to one or more electronic locks at the home and may be configured to control operation of the one or more electronic locks (e.g., control Z-Wave locks using wireless communications in the Z-Wave protocol). Further, the home automation controls 922 may be connected to one or more appliances at the home and may be configured to control operation of the one or more appliances. The home automation controls 922 may include multiple modules that are each specific to the type of device being controlled in an automated manner. The home automation controls 922 may control the one or more devices based on commands received from the control unit 910. For instance, the home automation controls 922 may cause a lighting system to illuminate an area to provide a better image of the area when captured by a camera 930.

The camera 930 may be a video/photographic camera or other type of optical sensing device configured to capture images. For instance, the camera 930 may be configured to capture images of an area within a building or home monitored by the control unit 910. The camera 930 may be configured to capture single, static images of the area and also video images of the area in which multiple images of the area are captured at a relatively high frequency (e.g., thirty images per second). The camera 930 may be controlled based on commands received from the control unit 910.

The camera 930 may be triggered by several different types of techniques. For instance, a Passive Infra-Red (PIR) motion sensor may be built into the camera 930 and used to trigger the camera 930 to capture one or more images when motion is detected. The camera 930 also may include a microwave motion sensor built into the camera and used to trigger the camera 930 to capture one or more images when motion is detected. The camera 930 may have a "normally open" or "normally closed" digital input that can trigger capture of one or more images when external sensors (e.g., the sensors 920, PIR, door/window, etc.) detect motion or other events. In some implementations, the camera 930 receives a command to capture an image when external devices detect motion or another potential alarm event. The camera 930 may receive the command from the controller 912 or directly from one of the sensors 920.

In some examples, the camera 930 triggers integrated or external illuminators (e.g., Infra-Red, Z-wave controlled "white" lights, lights controlled by the home automation controls 922, etc.) to improve image quality when the scene is dark. An integrated or separate light sensor may be used to determine if illumination is desired and may result in increased image quality.

The camera 930 may be programmed with any combination of time/day schedules, system "arming state", or other variables to determine whether images should be captured or not when triggers occur. The camera 930 may enter a low-power mode when not capturing images. In this case, the camera 930 may wake periodically to check for inbound messages from the controller 912. The camera 930 may be powered by internal, replaceable batteries if located remotely from the control unit 910. The camera 930 may employ a small solar cell to recharge the battery when light is available. Alternatively, the camera 930 may be powered by the controller 912's power supply if the camera 930 is co-located with the controller 912.

In some implementations, the camera 930 communicates directly with the monitoring server 960 over the Internet. In these implementations, image data captured by the camera 930 does not pass through the control unit 910 and the camera 930 receives commands related to operation from the monitoring server 960.

The system 900 also includes thermostat 934 to perform dynamic environmental control at the home. The thermostat 934 is configured to monitor temperature and/or energy consumption of an HVAC system associated with the thermostat 934, and is further configured to provide control of environmental (e.g., temperature) settings. In some implementations, the thermostat 934 can additionally or alternatively receive data relating to activity at a home and/or environmental data at a home, e.g., at various locations indoors and outdoors at the home. The thermostat 934 can directly measure energy consumption of the HVAC system associated with the thermostat, or can estimate energy consumption of the HVAC system associated with the thermostat 934, for example, based on detected usage of one or more components of the HVAC system associated with the thermostat 934. The thermostat 934 can communicate temperature and/or energy monitoring information to or from the control unit 910 and can control the environmental (e.g., temperature) settings based on commands received from the control unit 910.

In some implementations, the thermostat 934 is a dynamically programmable thermostat and can be integrated with the control unit 910. For example, the dynamically programmable thermostat 934 can include the control unit 910, e.g., as an internal component to the dynamically programmable thermostat 934. In addition, the control unit 910 can be a gateway device that communicates with the dynamically programmable thermostat 934. In some implementations, the thermostat 934 is controlled via one or more home automation controls 922.

A module 937 is connected to one or more components of an HVAC system associated with a home, and is configured to control operation of the one or more components of the HVAC system. In some implementations, the module 937 is also configured to monitor energy consumption of the HVAC system components, for example, by directly measuring the energy consumption of the HVAC system components or by estimating the energy usage of the one or more HVAC system components based on detecting usage of components of the HVAC system. The module 937 can communicate energy monitoring information and the state of the HVAC system components to the thermostat 934 and can control the one or more components of the HVAC system based on commands received from the thermostat 934.

In some examples, the system 900 further includes one or more robotic devices 990. The robotic devices 990 may be any type of robots that are capable of moving and taking actions that assist in home monitoring. For example, the robotic devices 990 may include drones that are capable of moving throughout a home based on automated control technology and/or user input control provided by a user. In this example, the drones may be able to fly, roll, walk, or otherwise move about the home. The drones may include helicopter type devices (e.g., quad copters), rolling helicopter type devices (e.g., roller copter devices that can fly and roll along the ground, walls, or ceiling) and land vehicle type devices (e.g., automated cars that drive around a home). In some cases, the robotic devices 990 may be devices that are intended for other purposes and merely associated with the system 900 for use in appropriate circumstances. For instance, a robotic vacuum cleaner device may be associated with the monitoring system 900 as one of the robotic devices 990 and may be controlled to take action responsive to monitoring system events.

In some examples, the robotic devices 990 automatically navigate within a home. In these examples, the robotic devices 990 include sensors and control processors that guide movement of the robotic devices 990 within the home. For instance, the robotic devices 990 may navigate within the home using one or more cameras, one or more proximity sensors, one or more gyroscopes, one or more accelerometers, one or more magnetometers, a global positioning system (GPS) unit, an altimeter, one or more sonar or laser sensors, and/or any other types of sensors that aid in navigation about a space. The robotic devices 990 may include control processors that process output from the various sensors and control the robotic devices 990 to move along a path that reaches the desired destination and avoids obstacles. In this regard, the control processors detect walls or other obstacles in the home and guide movement of the robotic devices 990 in a manner that avoids the walls and other obstacles.

In addition, the robotic devices 990 may store data that describes attributes of the home. For instance, the robotic devices 990 may store a floorplan and/or a three-dimensional model of the home that enables the robotic devices 990 to navigate the home. During initial configuration, the robotic devices 990 may receive the data describing attributes of the home, determine a frame of reference to the data (e.g., a home or reference location in the home), and navigate the home based on the frame of reference and the data describing attributes of the home. Further, initial configuration of the robotic devices 990 also may include learning of one or more navigation patterns in which a user provides input to control the robotic devices 990 to perform a specific navigation action (e.g., fly to an upstairs bedroom and spin around while capturing video and then return to a home charging base). In this regard, the robotic devices 990 may learn and store the navigation patterns such that the robotic devices 990 may automatically repeat the specific navigation actions upon a later request.

In some examples, the robotic devices 990 may include data capture and recording devices. In these examples, the robotic devices 990 may include one or more cameras, one or more motion sensors, one or more microphones, one or more biometric data collection tools, one or more temperature sensors, one or more humidity sensors, one or more air flow sensors, and/or any other types of sensors that may be useful in capturing monitoring data related to the home and users in the home. The one or more biometric data collection tools may be configured to collect biometric samples of a person in the home with or without contact of the person. For instance, the biometric data collection tools may include a fingerprint scanner, a hair sample collection tool, a skin cell collection tool, and/or any other tool that allows the robotic devices 990 to take and store a biometric sample that can be used to identify the person (e.g., a biometric sample with DNA that can be used for DNA testing).

In some implementations, the robotic devices 990 may include output devices. In these implementations, the robotic devices 990 may include one or more displays, one or more speakers, and/or any type of output devices that allow the robotic devices 990 to communicate information to a nearby user.

The robotic devices 990 also may include a communication module that enables the robotic devices 990 to communicate with the control unit 910, each other, and/or other devices. The communication module may be a wireless communication module that allows the robotic devices 990 to communicate wirelessly. For instance, the communication module may be a Wi-Fi module that enables the robotic devices 990 to communicate over a local wireless network at the home. The communication module further may be a 900 MHz wireless communication module that enables the robotic devices 990 to communicate directly with the control unit 910. Other types of short-range wireless communication protocols, such as Bluetooth, Bluetooth LE, Z-wave, Zigbee, etc., may be used to allow the robotic devices 990 to communicate with other devices in the home. In some implementations, the robotic devices 990 may communicate with each other or with other devices of the system 900 through the network 905.

The robotic devices 990 further may include processor and storage capabilities. The robotic devices 990 may include any suitable processing devices that enable the robotic devices 990 to operate applications and perform the actions described throughout this disclosure. In addition, the robotic devices 990 may include solid-state electronic storage that enables the robotic devices 990 to store applications, configuration data, collected sensor data, and/or any other type of information available to the robotic devices 990.

The robotic devices 990 are associated with one or more charging stations. The charging stations may be located at predefined home base or reference locations in the home. The robotic devices 990 may be configured to navigate to the charging stations after completion of tasks needed to be performed for the monitoring system 900. For instance, after completion of a monitoring operation or upon instruction by the control unit 910, the robotic devices 990 may be configured to automatically fly to and land on one of the charging stations. In this regard, the robotic devices 990 may automatically maintain a fully charged battery in a state in which the robotic devices 990 are ready for use by the monitoring system 900.

The charging stations may be contact based charging stations and/or wireless charging stations. For contact based charging stations, the robotic devices 990 may have readily accessible points of contact that the robotic devices 990 are capable of positioning and mating with a corresponding contact on the charging station. For instance, a helicopter type robotic device may have an electronic contact on a portion of its landing gear that rests on and mates with an electronic pad of a charging station when the helicopter type robotic device lands on the charging station. The electronic contact on the robotic device may include a cover that opens to expose the electronic contact when the robotic device is charging and closes to cover and insulate the electronic contact when the robotic device is in operation.

For wireless charging stations, the robotic devices 990 may charge through a wireless exchange of power. In these cases, the robotic devices 990 need only locate themselves closely enough to the wireless charging stations for the wireless exchange of power to occur. In this regard, the positioning needed to land at a predefined home base or reference location in the home may be less precise than with a contact based charging station. Based on the robotic devices 990 landing at a wireless charging station, the wireless charging station outputs a wireless signal that the robotic devices 990 receive and convert to a power signal that charges a battery maintained on the robotic devices 990.

In some implementations, each of the robotic devices 990 has a corresponding and assigned charging station such that the number of robotic devices 990 equals the number of charging stations. In these implementations, the robotic devices 990 always navigate to the specific charging station assigned to that robotic device. For instance, a first robotic device may always use a first charging station and a second robotic device may always use a second charging station.

In some examples, the robotic devices 990 may share charging stations. For instance, the robotic devices 990 may use one or more community charging stations that are capable of charging multiple robotic devices 990. The community charging station may be configured to charge multiple robotic devices 990 in parallel. The community charging station may be configured to charge multiple robotic devices 990 in serial such that the multiple robotic devices 990 take turns charging and, when fully charged, return to a predefined home base or reference location in the home that is not associated with a charger. The number of community charging stations may be less than the number of robotic devices 990.

In addition, the charging stations may not be assigned to specific robotic devices 990 and may be capable of charging any of the robotic devices 990. In this regard, the robotic devices 990 may use any suitable, unoccupied charging station when not in use. For instance, when one of the robotic devices 990 has completed an operation or is in need of battery charge, the control unit 910 references a stored table of the occupancy status of each charging station and instructs the robotic device to navigate to the nearest charging station that is unoccupied.

The system 900 further includes one or more integrated security devices 980. The one or more integrated security devices may include any type of device used to provide alerts based on received sensor data. For instance, the one or more control units 910 may provide one or more alerts to the one or more integrated security input/output devices 980. Additionally, the one or more control units 910 may receive one or more sensor data from the sensors 920 and determine whether to provide an alert to the one or more integrated security input/output devices 980.

The sensors 920, the home automation controls 922, the camera 930, the thermostat 934, and the integrated security devices 980 may communicate with the controller 912 over communication links 924, 926, 928, 932, 938, and 984. The communication links 924, 926, 928, 932, 938, and 984 may be a wired or wireless data pathway configured to transmit signals from the sensors 920, the home automation controls 922, the camera 930, the thermostat 934, and the integrated security devices 980 to the controller 912. The sensors 920, the home automation controls 922, the camera 930, the thermostat 934, and the integrated security devices 980 may continuously transmit sensed values to the controller 912, periodically transmit sensed values to the controller 912, or transmit sensed values to the controller 912 in response to a change in a sensed value.

The communication links 924, 926, 928, 932, 938, and 984 may include a local network. The sensors 920, the home automation controls 922, the camera 930, the thermostat 934, and the integrated security devices 980, and the controller 912 may exchange data and commands over the local network. The local network may include 802.11 "Wi-Fi" wireless Ethernet (e.g., using low-power Wi-Fi chipsets), Z-Wave, Zigbee, Bluetooth, "Homeplug" or other "Powerline" networks that operate over AC wiring, and a Category 5 (CAT5) or Category 6 (CAT6) wired Ethernet network. The local network may be a mesh network constructed based on the devices connected to the mesh network.

The monitoring server 960 is an electronic device configured to provide monitoring services by exchanging electronic communications with the control unit 910, the one or more user devices 940 and 950, and the central alarm station server 970 over the network 905. For example, the monitoring server 960 may be configured to monitor events generated by the control unit 910. In this example, the monitoring server 960 may exchange electronic communications with the network module 914 included in the control unit 910 to receive information regarding events detected by the control unit 910. The monitoring server 960 also may receive information regarding events from the one or more user devices 940 and 950.

In some examples, the monitoring server 960 may route alert data received from the network module 914 or the one or more user devices 940 and 950 to the central alarm station server 970. For example, the monitoring server 960 may transmit the alert data to the central alarm station server 970 over the network 905.

The monitoring server 960 may store sensor and image data received from the monitoring system and perform analysis of sensor and image data received from the monitoring system. Based on the analysis, the monitoring server 960 may communicate with and control aspects of the control unit 910 or the one or more user devices 940 and 950.

The monitoring server 960 may provide various monitoring services to the system 900. For example, the monitoring server 960 may analyze the sensor, image, and other data to determine an activity pattern of a resident of the home monitored by the system 900. In some implementations, the monitoring server 960 may analyze the data for alarm conditions or may determine and perform actions at the home by issuing commands to one or more of the controls 922, possibly through the control unit 910.

The monitoring server 960 can be configured to provide information (e.g., activity patterns) related to one or more residents of the home monitored by the system 900. For example, one or more of the sensors 920, the home automation controls 922, the camera 930, the thermostat 934, and the integrated security devices 980 can collect data related to a resident including location information (e.g., if the resident is home or is not home) and provide location information to the thermostat 934.

The central alarm station server 970 is an electronic device configured to provide alarm monitoring service by exchanging communications with the control unit 910, the one or more user devices 940 and 950, and the monitoring server 960 over the network 905. For example, the central alarm station server 970 may be configured to monitor alerting events generated by the control unit 910. In this example, the central alarm station server 970 may exchange communications with the network module 914 included in the control unit 910 to receive information regarding alerting events detected by the control unit 910. The central alarm station server 970 also may receive information regarding alerting events from the one or more user devices 940 and 950 and/or the monitoring server 960.

The central alarm station server 970 is connected to multiple terminals 972 and 974. The terminals 972 and 974 may be used by operators to process alerting events. For example, the central alarm station server 970 may route alerting data to the terminals 972 and 974 to enable an operator to process the alerting data. The terminals 972 and 974 may include general-purpose computers (e.g., desktop personal computers, workstations, or laptop computers) that are configured to receive alerting data from a server in the central alarm station server 970 and render a display of information based on the alerting data. For instance, the controller 912 may control the network module 914 to transmit, to the central alarm station server 970, alerting data indicating that a sensor 920 detected motion from a motion sensor via the sensors 920. The central alarm station server 970 may receive the alerting data and route the alerting data to the terminal 972 for processing by an operator associated with the terminal 972. The terminal 972 may render a display to the operator that includes information associated with the alerting event (e.g., the lock sensor data, the motion sensor data, the contact sensor data, etc.) and the operator may handle the alerting event based on the displayed information.

In some implementations, the terminals 972 and 974 may be mobile devices or devices designed for a specific function. Although FIG. 9 illustrates two terminals for brevity, actual implementations may include more (and, perhaps, many more) terminals.

The one or more authorized user devices 940 and 950 are devices that host and display user interfaces. For instance, the user device 940 is a mobile device that hosts or runs one or more native applications (e.g., the home monitoring application 942). The user device 940 may be a cellular phone or a non-cellular locally networked device with a display. The user device 940 may include a cell phone, a smart phone, a tablet PC, a personal digital assistant ("PDA"), or any other portable device configured to communicate over a network and display information. For example, implementations may also include Blackberry-type devices (e.g., as provided by Research in Motion), electronic organizers, iPhone-type devices (e.g., as provided by Apple), iPod devices (e.g., as provided by Apple) or other portable music players, other communication devices, and handheld or portable electronic devices for gaming, communications, and/or data organization. The user device 940 may perform functions unrelated to the monitoring system, such as placing personal telephone calls, playing music, playing video, displaying pictures, browsing the Internet, maintaining an electronic calendar, etc.

The user device 940 includes a home monitoring application 952. The home monitoring application 942 refers to a software/firmware program running on the corresponding mobile device that enables the user interface and features described throughout. The user device 940 may load or install the home monitoring application 942 based on data received over a network or data received from local media. The home monitoring application 942 runs on mobile devices platforms, such as iPhone, iPod touch, Blackberry, Google Android, Windows Mobile, etc. The home monitoring application 942 enables the user device 940 to receive and process image and sensor data from the monitoring system.

The user device 940 may be a general-purpose computer (e.g., a desktop personal computer, a workstation, or a laptop computer) that is configured to communicate with the monitoring server 960 and/or the control unit 910 over the network 905. The user device 940 may be configured to display a smart home user interface 952 that is generated by the user device 940 or generated by the monitoring server 960. For example, the user device 940 may be configured to display a user interface (e.g., a web page) provided by the monitoring server 960 that enables a user to perceive images captured by the camera 930 and/or reports related to the monitoring system. Although FIG. 9 illustrates two user devices for brevity, actual implementations may include more (and, perhaps, many more) or fewer user devices.

In some implementations, the one or more user devices 940 and 950 communicate with and receive monitoring system data from the control unit 910 using the communication link 938. For instance, the one or more user devices 940 and 950 may communicate with the control unit 910 using various local wireless protocols such as Wi-Fi, Bluetooth, Z-wave, Zigbee, HomePlug (ethernet over power line), or wired protocols such as Ethernet and USB, to connect the one or more user devices 940 and 950 to local security and automation equipment. The one or more user devices 940 and 950 may connect locally to the monitoring system and its sensors and other devices. The local connection may improve the speed of status and control communications because communicating through the network 905 with a remote server (e.g., the monitoring server 960) may be significantly slower.

Although the one or more user devices 940 and 950 are shown as communicating with the control unit 910, the one or more user devices 940 and 950 may communicate directly with the sensors and other devices controlled by the control unit 910. In some implementations, the one or more user devices 940 and 950 replace the control unit 910 and perform the functions of the control unit 910 for local monitoring and long range/offsite communication.

In other implementations, the one or more user devices 940 and 950 receive monitoring system data captured by the control unit 910 through the network 905. The one or more user devices 940, 950 may receive the data from the control unit 910 through the network 905 or the monitoring server 960 may relay data received from the control unit 910 to the one or more user devices 940 and 950 through the network 905. In this regard, the monitoring server 960 may facilitate communication between the one or more user devices 940 and 950 and the monitoring system.

In some implementations, the one or more user devices 940 and 950 may be configured to switch whether the one or more user devices 940 and 950 communicate with the control unit 910 directly (e.g., through link 938) or through the monitoring server 960 (e.g., through network 905) based on a location of the one or more user devices 940 and 950. For instance, when the one or more user devices 940 and 950 are located close to the control unit 910 and in range to communicate directly with the control unit 910, the one or more user devices 940 and 950 use direct communication. When the one or more user devices 940 and 950 are located far from the control unit 910 and not in range to communicate directly with the control unit 910, the one or more user devices 940 and 950 use communication through the monitoring server 960.

Although the one or more user devices 940 and 950 are shown as being connected to the network 905, in some implementations, the one or more user devices 940 and 950 are not connected to the network 905. In these implementations, the one or more user devices 940 and 950 communicate directly with one or more of the monitoring system components and no network (e.g., Internet) connection or reliance on remote servers is needed.

In some implementations, the one or more user devices 940 and 950 are used in conjunction with only local sensors and/or local devices in a house. In these implementations, the system 900 includes the one or more user devices 940 and 950, the sensors 920, the home automation controls 922, the camera 930, and the robotic devices 990. The one or more user devices 940 and 950 receive data directly from the sensors 920, the home automation controls 922, the camera 930, and the robotic devices 990, and sends data directly to the sensors 920, the home automation controls 922, the camera 930, and the robotic devices 990. The one or more user devices 940, 950 provide the appropriate interfaces/processing to provide visual surveillance and reporting.

In other implementations, the system 900 further includes network 905 and the sensors 920, the home automation controls 922, the camera 930, the thermostat 934, and the robotic devices 990, and are configured to communicate sensor and image data to the one or more user devices 940 and 950 over network 905 (e.g., the Internet, cellular network, etc.). In yet another implementation, the sensors 920, the home automation controls 922, the camera 930, the thermostat 934, and the robotic devices 990 (or a component, such as a bridge/router) are intelligent enough to change the communication pathway from a direct local pathway when the one or more user devices 940 and 950 are in close physical proximity to the sensors 920, the home automation controls 922, the camera 930, the thermostat 934, and the robotic devices 990 to a pathway over network 905 when the one or more user devices 940 and 950 are farther from the sensors 920, the home automation controls 922, the camera 930, the thermostat 934, and the robotic devices 990.

In some examples, the system leverages GPS information from the one or more user devices 940 and 950 to determine whether the one or more user devices 940 and 950 are close enough to the sensors 920, the home automation controls 922, the camera 930, the thermostat 934, and the robotic devices 990 to use the direct local pathway or whether the one or more user devices 940 and 950 are far enough from the sensors 920, the home automation controls 922, the camera 930, the thermostat 934, and the robotic devices 990 that the pathway over network 905 is required.

In other examples, the system leverages status communications (e.g., pinging) between the one or more user devices 940 and 950 and the sensors 920, the home automation controls 922, the camera 930, the thermostat 934, and the robotic devices 990 to determine whether communication using the direct local pathway is possible. If communication using the direct local pathway is possible, the one or more user devices 940 and 950 communicate with the sensors 920, the home automation controls 922, the camera 930, the thermostat 934, and the robotic devices 990 using the direct local pathway. If communication using the direct local pathway is not possible, the one or more user devices 940 and 950 communicate with the sensors 920, the home automation controls 922, the camera 930, the thermostat 934, and the robotic devices 990 using the pathway over network 905.

In some implementations, the system 900 provides end users with access to images captured by the camera 930 to aid in decision making. The system 900 may transmit the images captured by the camera 930 over a wireless WAN network to the user devices 940 and 950. Because transmission over a wireless WAN network may be relatively expensive, the system 900 can use several techniques to reduce costs while providing access to significant levels of useful visual information (e.g., compressing data, down-sampling data, sending data only over inexpensive LAN connections, or other techniques).

In some implementations, a state of the monitoring system and other events sensed by the monitoring system may be used to enable/disable video/image recording devices (e.g., the camera 930). In these implementations, the camera 930 may be set to capture images on a periodic basis when the alarm system is armed in an "away" state, but set not to capture images when the alarm system is armed in a "home" state or disarmed. In addition, the camera 930 may be triggered to begin capturing images when the alarm system detects an event, such as an alarm event, a door-opening event for a door that leads to an area within a field of view of the camera 930, or motion in the area within the field of view of the camera 930. In other implementations, the camera 930 may capture images continuously, but the captured images may be stored or transmitted over a network when needed.

The system 900 further includes the knife block 992 in communication with the control unit 910 through a communication link 994, which similarly to as described above in regards to communication links 924, 926, 928, 932, 938, and 984, may be wired or wireless and include a local network. The knife block 992 may be the knife block 110, the control unit 910 may be the control unit 102, the sensors 920 may include the sensors 118*a*-118*c* shown in FIGS. 2A-2D, the sensor 418 shown in FIGS. 4A-4E, one or more of the sensors 404*a*-404*g* shown in FIGS. 4A-4E, the automation controls 922 may include the actuator 332 shown in FIGS. 3A-3B.

The described systems, methods, and techniques may be implemented in digital electronic circuitry, computer hardware, firmware, software, or in combinations of these elements. Apparatus implementing these techniques may include appropriate input and output devices, a computer processor, and a computer program product tangibly embodied in a machine-readable storage device for execution by a programmable processor. A process implementing these techniques may be performed by a programmable processor executing a program of instructions to perform desired functions by operating on input data and generating appropriate output. The techniques may be implemented in one or more computer programs that are executable on a programmable system including at least one programmable processor coupled to receive data and instructions from, and to transmit data and instructions to, a data storage system, at least one input device, and at least one output device.

Each computer program may be implemented in a high-level procedural or object-oriented programming language, or in assembly or machine language if desired; and in any case, the language may be a compiled or interpreted language. Suitable processors include, by way of example, both general and special purpose microprocessors. Generally, a processor will receive instructions and data from a read-only memory and/or a random access memory. Storage devices suitable for tangibly embodying computer program instructions and data include all forms of non-volatile memory, including by way of example semiconductor memory devices, such as Erasable Programmable Read-Only Memory (EPROM), Electrically Erasable Programmable Read-Only Memory (EEPROM), and flash memory devices; magnetic disks such as internal hard disks and removable disks; magneto-optical disks; and Compact Disc Read-Only Memory (CD-ROM). Any of the foregoing may be supplemented by, or incorporated in, specially designed ASICs (application-specific integrated circuits).

It will be understood that various modifications may be made. For example, other useful implementations could be achieved if steps of the disclosed techniques were performed in a different order and/or if components in the disclosed systems were combined in a different manner and/or replaced or supplemented by other components. Accordingly, other implementations are within the scope of the disclosure.

What is claimed is:

1. An electronic knife holder, the electronic knife holder comprising:

a microprocessor;

a base member having a first exterior surface that contains multiple slots, each of the multiple slots defining an interior space of the base member and configured to receive a knife blade;

a lock that, when placed in a locked state, locks one or more knives placed in one or more of the multiple slots, the lock preventing the one or more knives from being removed from the base member; and sensors proximate to the multiple slots, at least one sensor of the sensors is disposed in the first exterior surface of the base member, the sensors configured to detect if a knife is present in one or more of the multiple slots, wherein the sensors are electronically coupled to the microprocessor.

2. The electronic knife holder of claim 1, wherein the lock is located in a housing that is coupled to a second surface of the base member.

3. The electronic knife holder of claim 1, wherein the lock is housed in the base member.

4. The electronic knife holder of claim 1, wherein the sensors comprise, for each of the slots the at least one sensor further disposed adjacent to a corresponding slot of the multiple slots.

5. The electronic knife holder of claim 1, wherein the sensors comprise, for each of the slots, one or more sensors coupled to an interior surface of the base member in a corresponding slot of the multiple slots.

6. The electronic knife holder of claim 1, wherein the sensors include a proximity sensor configured to detect if a knife is present in one or more of the multiple slots by detecting when a knife having a permanent magnet coupled to the knife or embedded in the knife is brought within a detection range of the proximity sensor.

7. The electronic knife holder of claim 6, wherein the proximity sensor is a Hall Effect sensor configured to detect if a knife is present in one or more of the multiple slots by detecting when a knife having a permanent magnet coupled to the knife or embedded in the knife is brought within a detection range of the Hall Effect sensor.

8. The electronic knife holder of claim 1, wherein the sensors include a contact sensor configured to detect if a knife is present in one or more of the multiple slots by coming into contact with one or more surfaces of a knife inserted into one of the multiple slots.

9. The electronic knife holder of claim 1, comprising a transceiver electronically coupled to the microprocessor, wherein the microprocessor is configured to:

wirelessly send data using the transceiver to a remote computing system, the data including at least one of the following:

data indicating that a knife has been removed from one of the multiple slots;

data indicating that a knife has been placed in one of the slots;

data indicating that the lock is in a locked state;

data indicating that the lock is in an unlocked state; or sensor data, or wirelessly receive data using the transceiver from the remote computing system, the data including at least one of the following:

instructions to lock the lock;

instructions to unlock the lock;

a request for a state of the lock;

a request for data indicating a number of knives removed from the electronic knife holder;

a request for data indicating the slots of the multiple slots that have knives placed in them; or a request for sensor data.

10. The electronic knife holder of claim 1, wherein the microprocessor is configured to:

receive sensor data;

in response to the sensor data, turn on a camera of the electronic knife holder;

capture image data using the camera;

in response to the image data, determine that a person in view of the camera is either unknown or is unauthorized to remove a knife;

actuate a lock that locks the knife into the electronic knife holder; and send a notification indicating at least on of that an unknown person attempted to remove the knife, that an unauthorized person attempted to remove the knife, or that the knife has been locked.

11. The electronic knife holder of claim 1, further comprising:

a camera disposed in the first exterior surface of the base member, wherein the camera is configured to capture image data of an area in which the electronic knife holder is located.

12. The electronic knife holder of claim 11, wherein the microprocessor is configured to:

process the image data captured using the camera;

perform facial recognition using the processed image data; and perform one or more of the following:

modify a state of the lock to unlock the lock if results of facial recognition indicate a user is recognized and if the recognized user is determined to be permitted to retrieve a knife;

modify a state of the lock to lock the lock if results of facial recognition indicate a user is not recognized; and modify a state of the lock to lock the lock if results of facial recognition indicate a user is recognized and if the recognized user is determined to not be permitted to retrieve a knife.

13. The electronic knife holder of claim 11, wherein the microprocessor is configured to:

transmit image data captured using the camera to a remote computing device;

receive, from the remote computing device, data indicating that (i) a user is recognized from the image data and (ii) the user is permitted to retrieve a knife from the electronic knife holder; and modify a state of the lock to unlock the lock to allow the user to retrieve a knife from a slot of the multiple slots.

14. The electronic knife holder of claim 11, wherein the microprocessor is configured to:

transmit image data captured using the camera to a remote computing device;

receive, from the remote computing device, data indicating that (i) a user is recognized from the image data and (ii) the user is not permitted to retrieve a knife from the electronic knife holder; and modify a state of the lock to lock the lock to prevent the user from retrieving a knife from a slot of the multiple slots.

15. The electronic knife holder of claim 11, wherein the microprocessor is configured to:

transmit image data captured using the camera to a remote computing device;

receive, from the remote computing device, data indicating that a user is not recognized from the image data; and modify a state of the lock to lock the lock to prevent the user from retrieving a knife from a slot of the multiple slots.

16. The electronic knife holder of claim 11, wherein the microprocessor or processor is configured to turn on the camera and instruct the camera to capture the image data in response to receiving sensor data from at least one of the sensors indicating that a knife has been removed or partially removed from a slot of the multiple slots.

17. The electronic knife holder of claim 11, wherein the microprocessor or processor is configured to turn on the camera and instruct the camera to capture the image data in response to receiving sensor data from at least one of the sensors indicating that movement has been detected in a vicinity of the electronic knife holder.

18. The electronic knife holder of claim 11, wherein the microprocessor is configured to receive instructions to lock the lock in response to one or more of the following:

time of day;

users in a property where the electronic knife holder is located;

users in a vicinity of the electronic knife holder;

a schedule;

a mode of a security system in the property where the electronic knife holder is located; or a detected security event.

19. An electronic knife holder, the electronic knife holder comprising:

a microprocessor;

a base member having a first exterior surface that contains multiple slots, each of the multiple slots defining an interior space of the base member and configured to receive a knife blade;

a lock that, when placed in a locked state, locks one or more knives placed in one or more of the multiple slots, the lock preventing the one or more knives from being removed from the base member; and sensors proximate to the multiple slots, the sensors configured to detect if a knife is present in one or more of the multiple slots, wherein the sensors are electronically coupled to the microprocessor, wherein:

the base member comprises an interior channel that passes through at least a subset of the multiple slots; and the lock comprises:

a bolt; and an actuator that is configured to move the bolt through the interior channel to lock or unlock one or more knives placed in the subset of the multiple slots.

20. An electronic knife holder, the electronic knife holder comprising:

a microprocessor;

a base member having a first exterior surface that contains multiple slots, each of the multiple slots defining an interior space of the base member and configured to receive a knife blade;

a lock that, when placed in a locked state, locks one or more knives placed in one or more of the multiple slots, the lock preventing the one or more knives from being removed from the base member; and sensors proximate to the multiple slots, the sensors configured to detect if a knife is present in one or more of the multiple slots, wherein the sensors are electronically coupled to the microprocessor, wherein the microprocessor is configured to:

receive first sensor data;

determine that a knife is present in one of the multiple slots of the electronic knife holder in response to the first sensor data;

receive second sensor data;

determine that the knife is dull in response to the second sensor data;

actuate a lock that locks the knife into the electronic knife holder; and send a notification indicating at least one of that the knife is dull or that the knife has been locked.

* * * * *